US010500892B2

(12) United States Patent
Nguegang

(10) Patent No.: US 10,500,892 B2
(45) Date of Patent: Dec. 10, 2019

(54) METHOD AND APPARATUS WITH ROTATING TOOL CHANGER FOR AUTOMATED MULTIPLE SIDES WORKPIECE MACHINING

(71) Applicant: Gino Francis Nguegang, Chicago, IL (US)

(72) Inventor: Gino Francis Nguegang, Chicago, IL (US)

( * ) Notice: Subject to any disclaimer, the term of this patent is extended or adjusted under 35 U.S.C. 154(b) by 187 days.

(21) Appl. No.: 15/700,131

(22) Filed: Sep. 10, 2017

(65) Prior Publication Data

US 2019/0077185 A1 Mar. 14, 2019

(51) Int. Cl.

| | |
|---|---|
| ***B44B 3/00*** | (2006.01) |
| *B44B 3/06* | (2006.01) |
| *B27C 5/06* | (2006.01) |
| *B27C 1/08* | (2006.01) |

(52) U.S. Cl.

CPC ..... *B44B 3/006* (2013.01); *B27C 1/08* (2013.01); *B27C 5/06* (2013.01); *B44B 3/009* (2013.01); *B44B 3/061* (2013.01); *B44B 3/065* (2013.01)

(58) Field of Classification Search

CPC ..... B44B 3/006; B44B 3/009; B44B 3/061; B44B 3/065; B27C 1/08; B27C 5/00; B27C 5/06; B27C 9/04

See application file for complete search history.

(56) References Cited

U.S. PATENT DOCUMENTS

| | | | | |
|---|---|---|---|---|
| 1,984,552 | A * | 12/1934 | Scott | B44B 3/006 409/85 |
| 4,429,726 | A * | 2/1984 | Betzler | B27G 13/12 144/117.1 |
| 4,878,524 | A * | 11/1989 | Rosenthal | B23D 45/102 144/356 |
| 5,345,983 | A * | 9/1994 | de Abreu | B23Q 35/108 144/114.1 |
| 5,569,003 | A * | 10/1996 | Goldman | B23Q 7/10 221/124 |
| 7,490,710 | B1 * | 2/2009 | Weskamp | B23Q 7/1426 198/345.3 |
| 9,789,609 | B2 * | 10/2017 | Crothers | B25J 9/009 |

(Continued)

*Primary Examiner* — Christopher R Harmon

(57) ABSTRACT

A method and an apparatus with rotating tool changer for automatically machining multiple sides of a workpiece which is trimmed and machined according to tags placed on the workpiece or preprogrammed sequence. A method that automatically selects and adjusts parametric computer machining code to machine various workpieces sizes. An apparatus comprising a handling and trimming station of parts to be machined, multiple optical, magnetic or radio-frequency identification (RFID) reading systems for processing labels or tags information for sequential workpieces machining steps, a multiple gantries computer numerical control (CNC) station for machining workpieces on various sides, multiple rotating tool changers for selecting tools used to machine workpieces, and a storage station that receives workpieces in sequential order when they have been processed. The moving gantries of the CNC station simultaneous machine multiple sides of the workpiece which in the preferred embodiment is composed of panel for making decorative items and engraved doors.

17 Claims, 17 Drawing Sheets

(56) References Cited

U.S. PATENT DOCUMENTS

| | | | | |
|---|---|---|---|---|
| 2003/0207742 | A1* | 11/2003 | Hazlehurst | B21C 51/005 483/36 |
| 2010/0200642 | A1* | 8/2010 | Burford | B23K 20/1265 228/112.1 |
| 2014/0287897 | A1* | 9/2014 | George | B23Q 3/15513 483/1 |
| 2015/0266147 | A1* | 9/2015 | Reid | B23P 21/004 29/525.01 |
| 2017/0297218 | A1* | 10/2017 | Friese | B25B 5/003 |

* cited by examiner

DETAIL B

METHOD AND APPARATUS WITH ROTATING TOOL CHANGER FOR AUTOMATED MULTIPLE SIDES WORKPIECE MACHINING

CROSS-REFERENCE TO RELATED APPLICATIONS

This application is a continuation of U.S. application Ser. No. 15/284,358, filed Oct. 3, 2016, now abandoned.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Field of the Invention

The present invention relates to a method and an apparatus with rotating tool changer that automatically processes workpieces on multiple sides to make decorative items, doors and other multiple sides workpiece processing items.

Background Art

Most computer numerical control (CNC) machine tools such as routers and/or engravers used in the woodworking and advertising industries are comprised of a moving or fixed gantry that machines one side of parts on a horizontal bed frame. The other side if machining is required needs to be turned over and machined after the first side has been machined. This result in a time consuming process where each side of the part has to be machined separately, one side after the other. Moreover in manufacturing custom size doors one has to program each door size which is another time consuming process. In manufacturing different sizes of doors with the same engraved design one has to provide computer code to the machine controller for the specific door size. Use of parametric computer code is used in the industry, but most of the time it is done offline or prior to part machining. The parametric computer code is later sent to the machine controller as needed. There is also a limitation of current manufacturing apparatus for panels with blank panel sizes specified prior to engraving or routing for a one size machining not adapted to dynamic machining of different sizes of panels and patterns based on rapid user request for various sizes and patterns.

There is a need to bring all the different parts of computer numerical control machining into a combine system that takes into account all the aforementioned limitations. It is therefore the objectives of the present invention to provide a method and an apparatus for machining multiples side of a workpiece which come from a feeding station with multiples blank workpieces of various sizes. The workpiece is dynamically trimmed based on final dimensions and machined with different patterns using parametric computer codes.

Various machines and methods for producing engraved, printed or routed items have been described, build and sold over the years. The following patents described the prior art with its limitations:

In U.S. Pat. No. 6,334,745 an "Apparatus and method for working double sided workpiece" is disclosed for processing mainly printed circuit board one piece after the others with mechanically linked working heads for both sides.

In U.S. Pat. No. 6,943,314 a "Method for producing a double-sided rabies ID tag" has been described with limitation of turning the blank after one side is engraved.

In U.S. Pat. No. 8,424,216 a "Dual-side engraving system" has been described with a cartridge holding item to be engraved and a flipping system for engraving multiple sides of the item confined in size in the cartridge.

BRIEF SUMMARY OF THE INVENTION

This invention provides a method and an apparatus for automatically processing workpieces of various sizes on its multiple sides based on preprogrammed user input data, information placed on the workpieces or information sent from a remote device.

The main advantages of the present invention are:

to provide a method and an apparatus that consistently reduce the handling steps and time to manufacture and process decorative panels, doors and others products;

to provide a manufacturing station that automates workpieces manufacturing such as doors on its multiple sides without the need to reposition the workpieces;

to provide an automated mean to manufacture workpieces of different sizes with engraving patterns adjusted to the workpiece size;

to simplify operator's procedures and programming with the use of easy operator interface and parametric machine code programming.

The invention incorporates:

a user interface system which is used to program the apparatus operation, interact with the apparatus and display apparatus outputs;

a computer that stores and processes the parametric numerical control codes which are sent to the computer numerical control (CNC) controllers and also processes the user inputs which drive the apparatus;

an optical, magnetic or radio frequency identification (RFID) reading system that processes information on the workpiece which is sent to the apparatus computer for further processing;

an automated workpieces handling and trimming station that feeds workpieces for further processing wherein workpieces are placed in a loading compartment with an indexing mechanism that feeds them to the trimming device after placed label or information on the workpieces is read from an optical, magnetic or RFID reading system that sends information to a controller which drives the trimming station;

a trimming device with interchangeable tools that cuts or processes workpieces based on preprogrammed sequences or labels affixed to the workpieces;

multiple controllers that process workpieces information, user input data and programming code which then drive the multiple gantries computer numerical control (CNC) workpieces processing station and their respective rotating tool changer;

multiple rotating tool changers for selecting tools used to machine or process workpieces;

a storage station that receives workpieces in sequential order from the multiple gantries CNC workpieces processing station.

DETAILED DESCRIPTION OF THE INVENTION

Embodiments of the present invention are described herein with drawings and relevant components, such that those skilled in the art can have an understanding of the apparatus and method described to process multiple sides of various workpieces and objects which required such processing. Embodiments depicted in FIGS. 1 to 11 apply to panels processing but one should understand that the invention is not limited to such flat objet and can be used with others forms.

Figure 1:
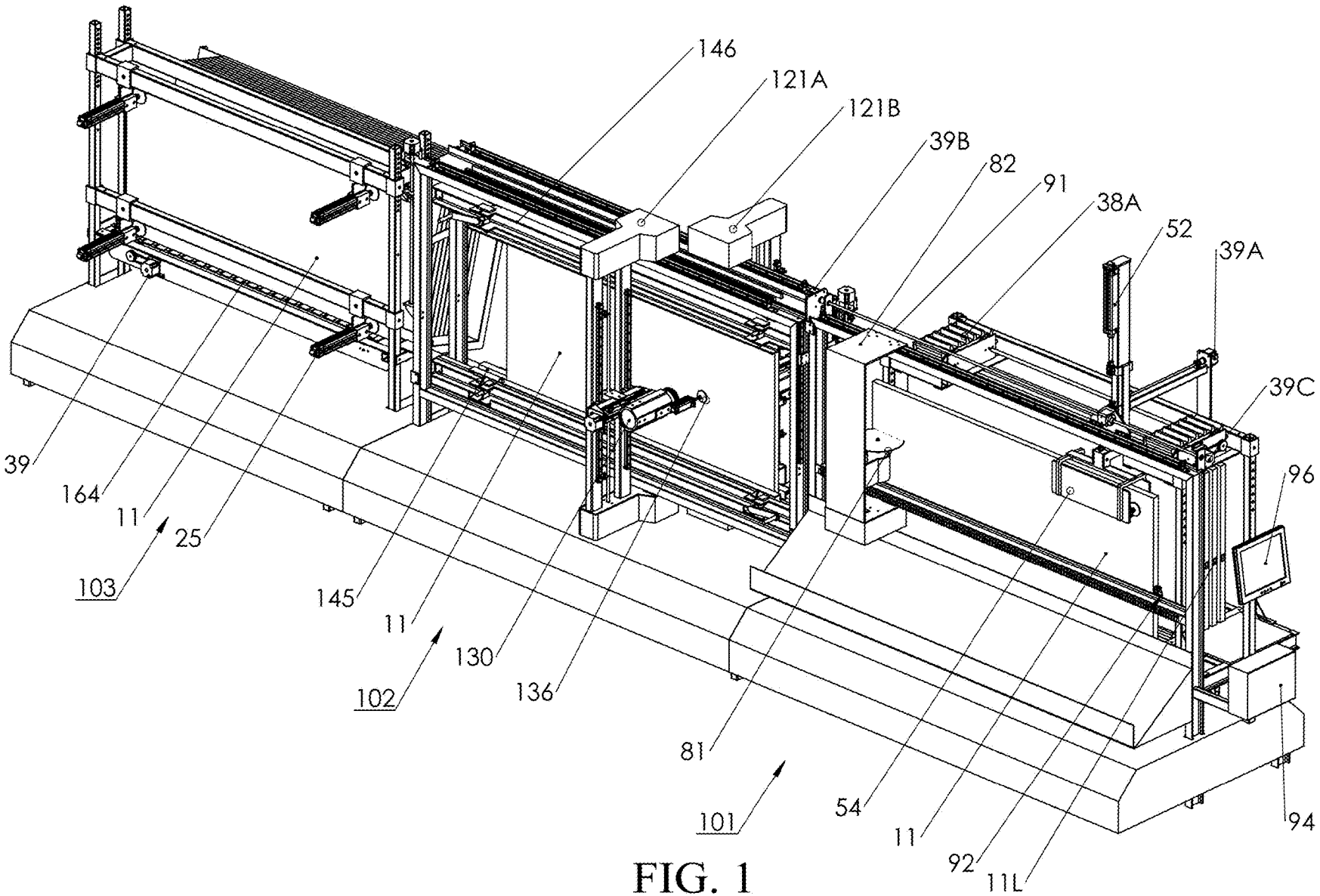
FIG. 1 is an overall isometric view for illustrating the apparatus of the present invention.

FIG. 1 illustrates one of the embodiments of the present invention consisting of an automated workpieces handling and trimming station 101, a dual gantry computer numerical control (CNC) workpiece processing station 102 and a storage station 103. The automated workpieces handling and trimming station 101 comprises a set of multiple workpieces 11 placed vertically and which are indexed and advanced for further processing with four indexing subassemblies 38A driven by two stepper motors 39C. While ready to be processed workpiece 11 is held in place with pneumatic clamp subassembly 54 driven vertically by pneumatic cylinder 52 and horizontally by stepper motor 39A. Pneumatic clamp subassembly 54 provides a strong grip to allow moveable trimming tool subassembly 82 to trim workpiece 11 with the help of a trimming tool which is in this embodiment a cutting saw 81. Although trimming tool subassembly 82 is depicted with a cutting saw 81, it is understood that the cutting device can be replaced with a different tool, such as a cutting bit, a laser, or a waterjet cutter to fit the material being cut. The amount of material to be trimmed from workpiece 11 which will go through further processing in station 102 is read with a reading device, such as a RFID reader, a magnetic reader, or an optical reader 92 from labels 11L affixed to workpieces as shown on FIG. 2B. Computer 94 controls the operations of stations 101, 102, 103 and the overall processing of workpieces 11 based on preprogrammed sequences and information read from labels 11L, or user input instructions received either from the user interface system 96 which has buttons along with touch sensitive screen or through remote connection. When processing operations of workpiece 11 are finished on trimming station 101, clamp subassembly 54 hold firmly workpiece 11 which is then driven rearward by the rotating motion of lead screw 91 and stepper motor 39B. While clamp subassembly 54 has reached its rearward motion limit, the synchronized motion of the two gantries 121A and 121B with the actuation of both clamps 136 further displaced workpiece 11 in its final position within the computer numerical control (CNC) workpieces processing station 102.

The dual independent gantries 121A and 121B of processing station 102 allow to process at the same time workpiece 11 with two different operations or patterns. One preferred embodiment is the engraving or routing of panels and doors which can be processed with a router 130 with similar or different patterns on both sides at the same time. Workpiece 11 is held in place in station 102 with the assistance of one top height adjustable clamp 146 and one bottom stationary clamp 145. When all operations performed on workpiece 11 are completed on processing station 102, clamps 145 and 146 are released and the two pneumatic clamps 136 are activated on both sides of workpiece 11 which then hold workpiece 11 firmly for displacement to station 103. The synchronized rearward motion of gantries 121A, 121B and actuation of both clamps 136 move workpiece 11 to the storage station 103.

Storage station 103 further comprises a conveyor belt 164 driven by motor 39 to move rearward workpiece 11 which at the end of travel is pushed by four actuators 25 to a rack.

Figures 2A, 2B:
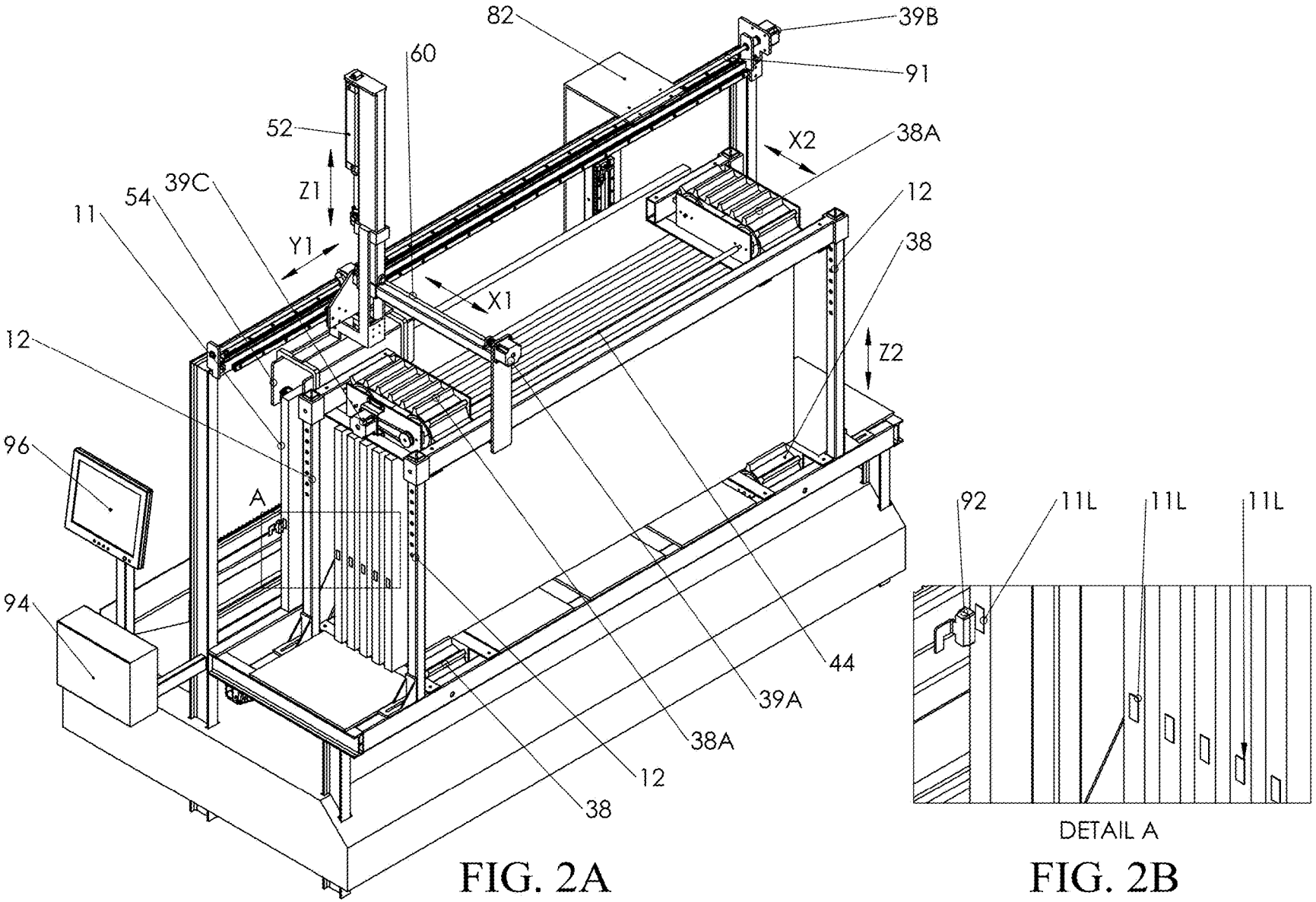
FIG. 2A is the general isometric view of the automated workpieces handling and trimming station.
FIG. 2B is a detailed view of a portion of the automated workpieces handling and trimming station showing the labels affixed to the workpieces, and the optical, magnetic or RFID reading system that reads the information on the labels.

FIG. 2A illustrates some key components, relative motions of actuators and subassemblies to better understand the functioning of the automated workpieces handling and trimming station 101. A plurality of blank workpieces 11 are arranged vertically on the base of station 101 which comprises two sets of fixed height indexing subassembly 38, and two sets of adjustable height indexing subassembly 38A which are allowed to move vertically in the Z2 direction by sliding on the four poles 12 in order to adjust to different workpiece 11 height. The two sets of adjustable height indexing subassembly 38A are linked together with a lead screw 44 which is rotated by stepper motor 39C. The two sets of fixed height indexing subassembly 38 have a similar arrangement with another stepper motor synchronized to 39C to allow for perfect leftward motion of blank workpieces 11 in one of the two X2 directions. Clamp subassembly 54 has motion in the X1, Y1 and Z1 directions. Before workpiece 11 reached its further left position, clamp subassembly 54 is moved upward in one of the two Z1 directions in order not to interfere with the motion of workpiece 11 in the X2 direction. Once workpiece 11 has reached its further left position from the motion of the four indexing subassemblies 38 and 38A, clamp subassembly 54 goes up in the upper Z1-direction by the actuation of pneumatic cylinder 52, moves slightly right to the right X1 direction, goes back down in the lower Z1-direction by the reverse actuation of pneumatic cylinder 52 and grabs the further left set of workpieces 11 and move it further left to the left X1 direction by the rotation of lead screw 60 and stepper motor 39A to its final trimming position. Once workpiece 11 has reached its final trimming position, if required by the processing operations to be performed on the workpiece, trimming tool subassembly 82 will displace to cut through workpiece 11. Once cutting or trimming of workpiece 11 is completed, clamp subassembly 54 will further move downward to grab the remaining part of workpiece 11 and move it forward to the forward Y1 direction by the rotation of lead screw 91 and stepper motor 39B to the next computer numerical control (CNC) workpieces processing station 102.

FIG. 2B illustrates how the information is read from the labels 11L affixed to multiple workpieces 11 and processed with a reading device such as, an optical, a magnetic or a RFID reader 92 system that reads the information on each label 11L and sends it to the computer 94 for further processing. The label has information such as, the workpiece size, the workpiece material, the cutting or trimming height if necessary, the router speed based on workpiece material, and any other operations to be performed on the multiple gantries computer numerical control workpieces processing station 102.

Figure 3B:
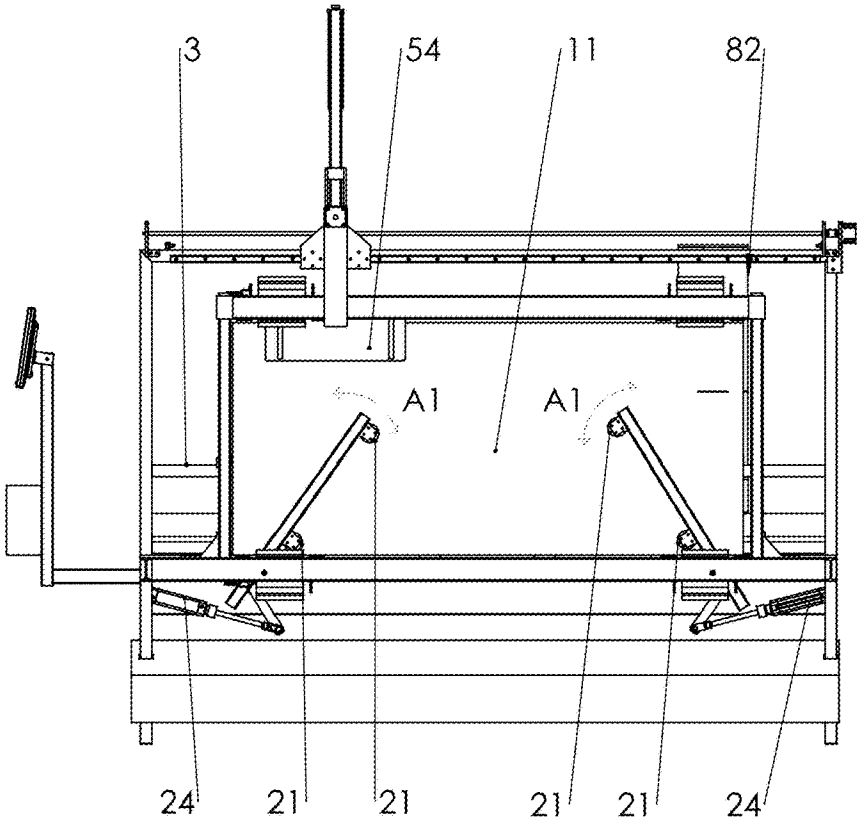
FIG. 3B is a side view of the automated workpieces handling and trimming station with workpieces clamping devices in the raised position.
Figure 3A:
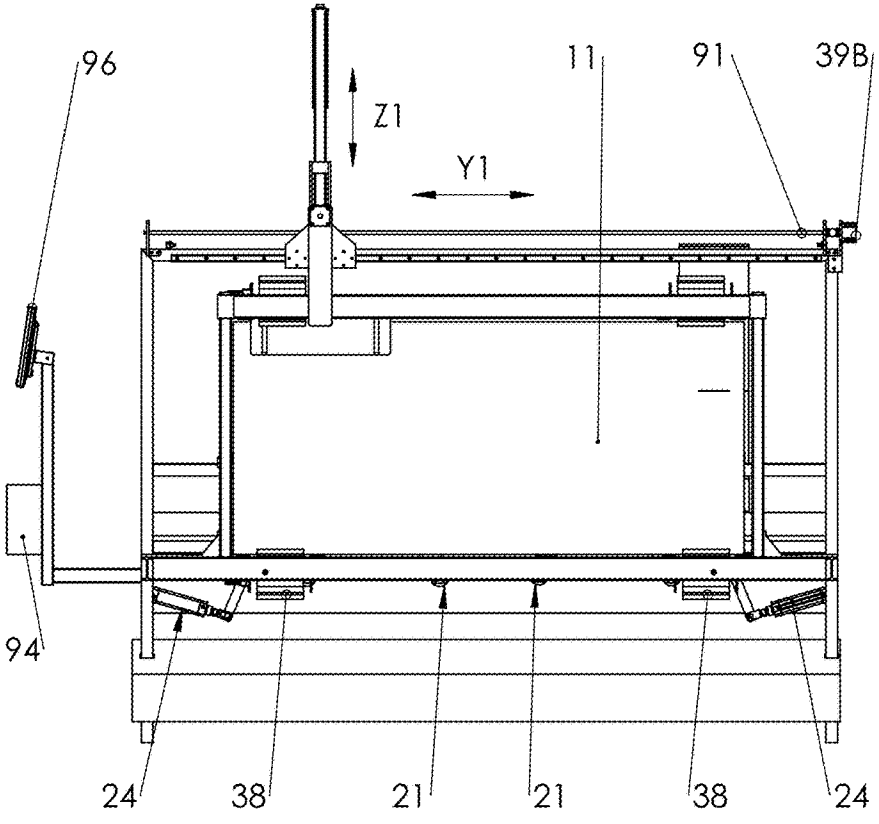
FIG. 3A is a side view of the automated workpieces handling and trimming station with workpieces clamping devices in the lowered position.

FIG. 3A further illustrates the operation of the automated workpieces handling and trimming station 101 with the motion of four sets of workpiece clamping devices 21. In this right side view, workpiece 11 is shown before clamping devices 21 are activated and displaced by two actuators 24.

FIG. 3B further illustrates the operation of the automated workpieces handling and trimming station 101 with the motion of four sets of workpiece clamping devices 21. In this right side view, workpiece 11 is shown after clamping devices 21 are activated and displaced by two actuators 24 in a rotating motion A1. Clamping devices 21 are used to press workpiece 11 against bar 3 in order to firmly hold workpiece 11 and allow trimming tool subassembly 82 to easily cut through. After cutting is completed, clamp subassembly 54 is lowered in order to hold the remaining part of workpiece 11 as shown on FIG. 4B and clamping devices 21 are retracted to the position shown on FIG. 3A.

Figures 4A, 4B, 4C:
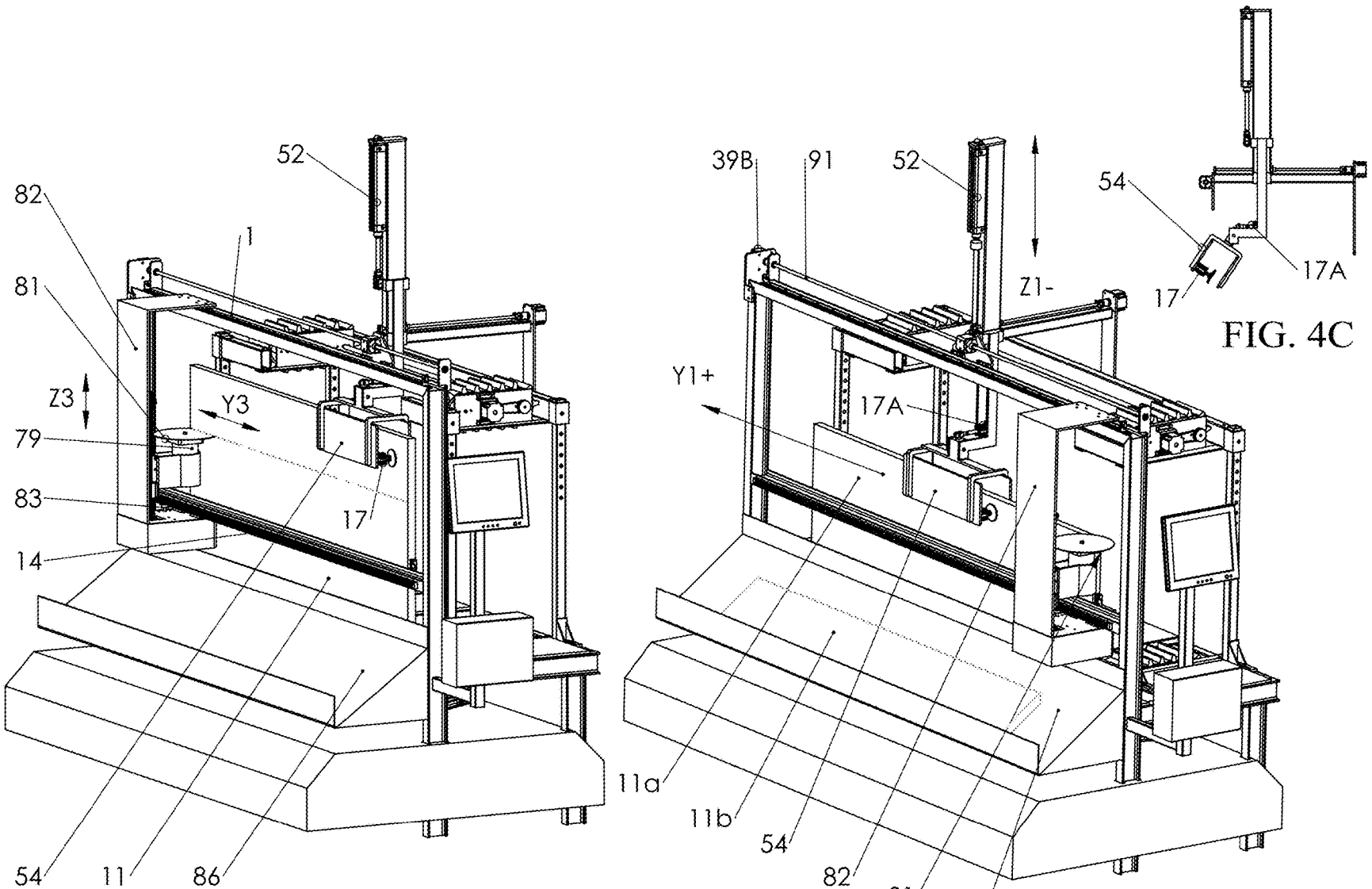
FIG. 4A is an isometric view of the automated workpieces handling and trimming station showing the workpiece before saw processing.
FIG. 4B is an isometric view of the automated workpieces handling and trimming station showing the workpiece after saw processing.
FIG. 4C is a detailed view of the automated workpieces handling and trimming station showing the workpiece gripping device in a rotated position.

FIG. 4A further illustrates the operation of the automated workpieces handling and trimming station 101 with the operation of the cutting saw 81 driven by motor 79 which can move up and down in the Z3 direction to adjust for different workpiece 11 cutting height. Trimming tool subassembly 82 cut through workpiece 11 in the Y3 direction by moving on two sets of rail 1, one on top (shown) and one on the bottom and with the rotating action of pinion 83 on rack 14. Clamp subassembly 54 is lowered to hold the top side of workpiece 11 with the actuation of two internal holding actuators 17.

FIG. 4B further illustrates the operation of the automated workpieces handling and trimming station 101 after trimming tool subassembly 82 has cut through workpiece 11 in two pieces 11*a* and 11*b*. Piece 11*b* is first held by clamp subassembly 54 while piece 11*a* is secured by clamping devices 21 has shown on FIG. 3B. After cutting of workpiece 11 is completed, clamp subassembly 54 holds piece 11*b* with actuators 17 and rotates as shown on FIG. 4C by the motion of actuator 17A. Releasing actuators 17 allow piece 11*b* to drop in the receiving chute 86. After releasing piece 11*b*, clamp subassembly 54 moves down to hold firmly piece 11*a* which allows clamping devices 21 to disengage and retract to position shown on FIG. 3A. Clamp subassembly 54 which still holds firmly piece 11*a* can move it in the Y1+ direction to the dual gantry computer numerical control (CNC) workpieces processing station 102 for further processing.

FIG. 4C illustrates the motion of clamp subassembly 54 which can rotate with the motion of actuator 17A in order to hold and release in the chute 86 from the actuation of actuators 17, the top section of workpiece 11 illustrated as piece 11*b* in FIG. 4B.

Figure 5:
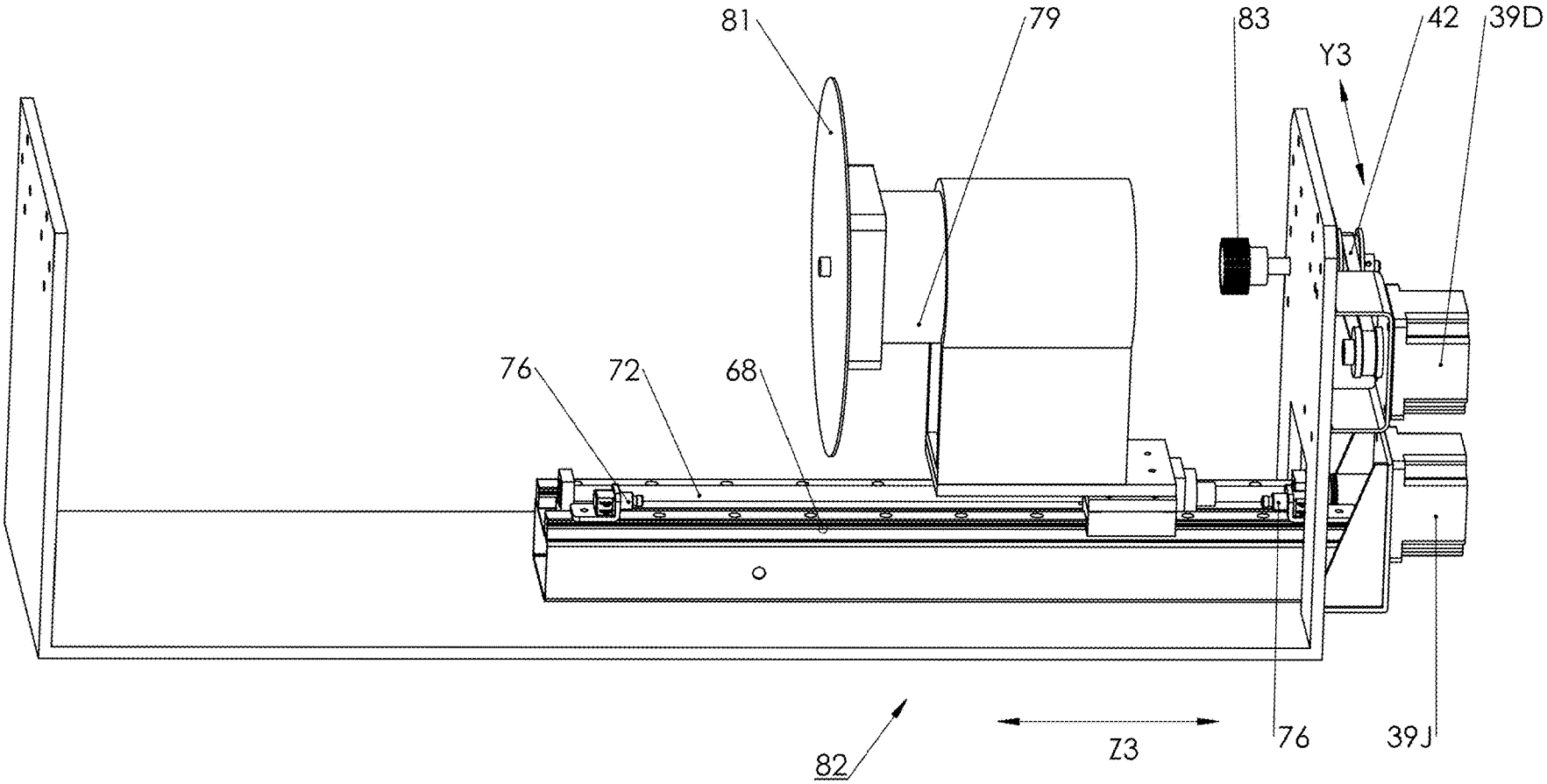
FIG. 5 is a detailed view of the trimming tool subassembly within the automated workpieces handling and trimming station.

FIG. 5 illustrates the trimming tool subassembly 82 with cutting saw 81 driven by motor 79. It should be noted that the cutting subassembly is not limited to the embodiment depicted and can be composed of various components; for example, cutting bit, laser, plasma, wire or waterjet cutters to fit the material being cut and the operation to be performed on the dual gantry computer numerical control (CNC) workpieces processing station 102. Pinion 83 is rotated by timing belt 42 and stepper motor 39D in order to move cutting subassembly 82 in the Y3 direction. Cutting saw 81 is displaced up and down in the Z3 direction to allow for different cutting height of workpiece 11. The motion of cutting saw 81 driven by motor 79 sliding on rail 68 in the Z3 direction is linked to the rotation of stepper motor 39J and lead screw 72. Limit switches 76 used to control motion in either direction are shown on this trimming tool subassembly 82. It should be noted that all motions described in this description have means of limiting their respective displacement with different type of limit switches not restricted to mechanical contact switch.

Figure 6B:
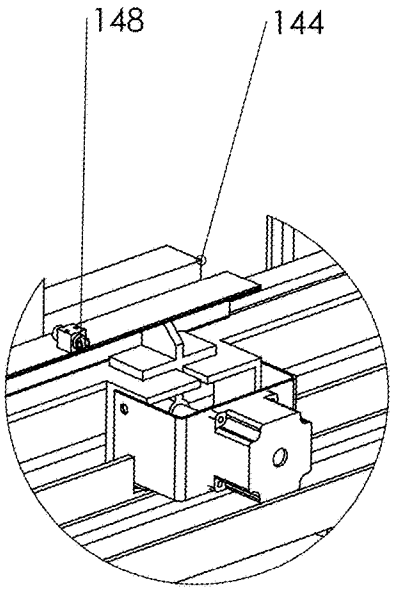
FIG. 6B is a detailed view of the lower workpiece clamp and limit switch within the multiple gantries computer numerical control workpieces processing station.
Figure 6A:
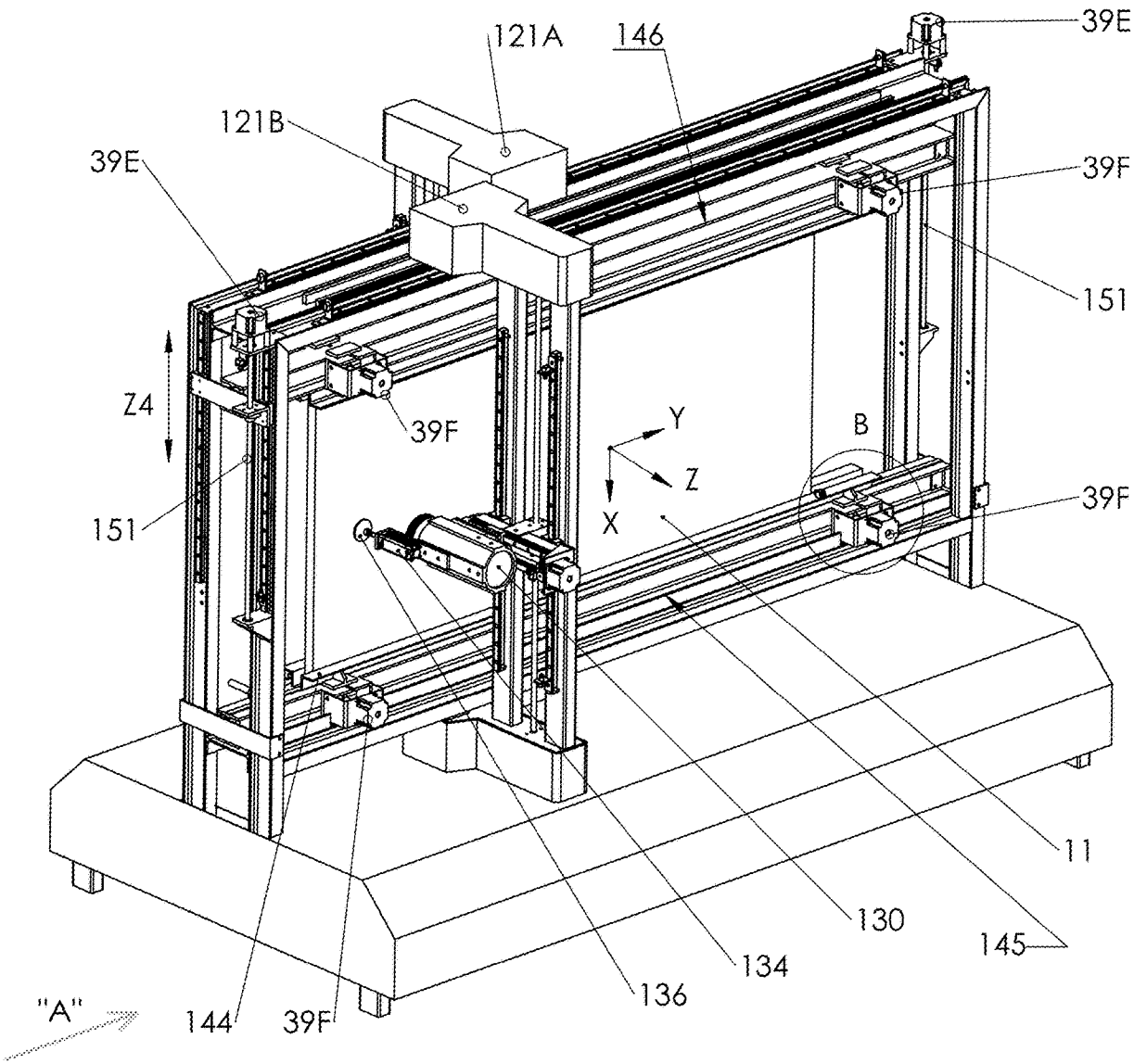
FIG. 6A is the general isometric view of the multiple gantries computer numerical control workpieces processing station.

FIG. 6A illustrates the multiple gantries computer numerical control workpieces processing station 102 with two independent gantries 121A and 121B. They allow the processing of two independent patterns or operations simultaneously on both sides of workpiece 11. Even though one of the preferred embodiments is shown with two routers 130 (only one shown), each gantry can be mounted with different apparatus such as, laser engraver, sand or particles blasting, product dispensing, and more. That will allow a given workpiece to be processed with different operations or patterns on both sides. While workpiece 11 is processed in station 102, one top height-adjustable clamp 146 and one bottom stationary clamp 145 are used to hold workpiece 11 in place with the actuation of stepper motors 39F and clamping bars 144. To allow clamping of different workpiece height, the top height-adjustable clamp 146 is allowed to move in the Z4 direction by the motion of two stepper motors 39E and lead screws 151.

Figure 7C:
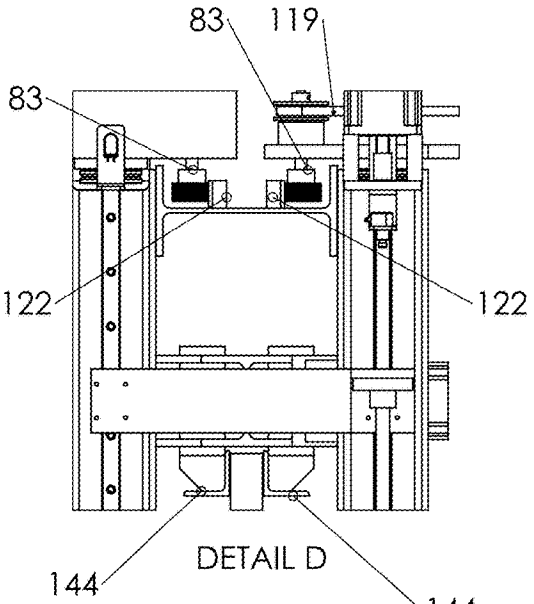
FIG. 7C is a detailed view of the stationary workpiece clamping system and portion of the drive assembly within the multiple gantries computer numerical control workpieces processing station.
Figure 7B:
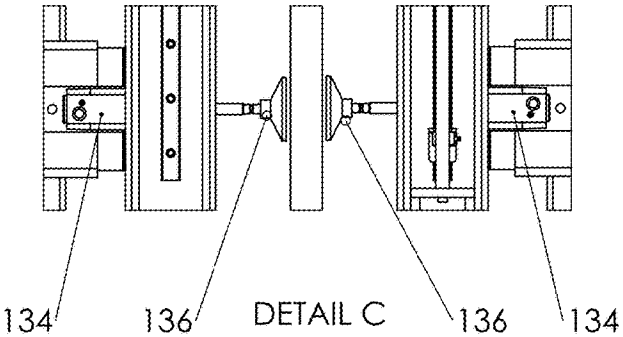
FIG. 7B is a detailed view of the moving workpiece clamping system within the multiple gantries computer numerical control workpieces processing station.

After work is completed on workpiece 11, two sets of clamping device 136 and their respective actuator 134 as shown on FIG. 7B, hold firmly workpiece 11 from the opposing clamping action of both clamping devices 136. Workpiece 11 is then displaced by the combined motion of gantries 121A and 121B in the Y direction to the storage station 103.

FIG. 6B illustrates the bottom clamping bar 144 within the stationary clamp 145 and the optical limit switch 148. While receiving workpiece 11 from station 101 two sets of clamping device 136 and their respective actuator 134 as shown on FIG. 7B hold firmly workpiece 11 which is displaced by the motion of gantries 121A and 121B in the Y direction until it gets to optical limit switch 148. At that moment, workpiece clamping systems 145 and 146 are actuated to hold workpiece 11 in place.

Figure 7A:
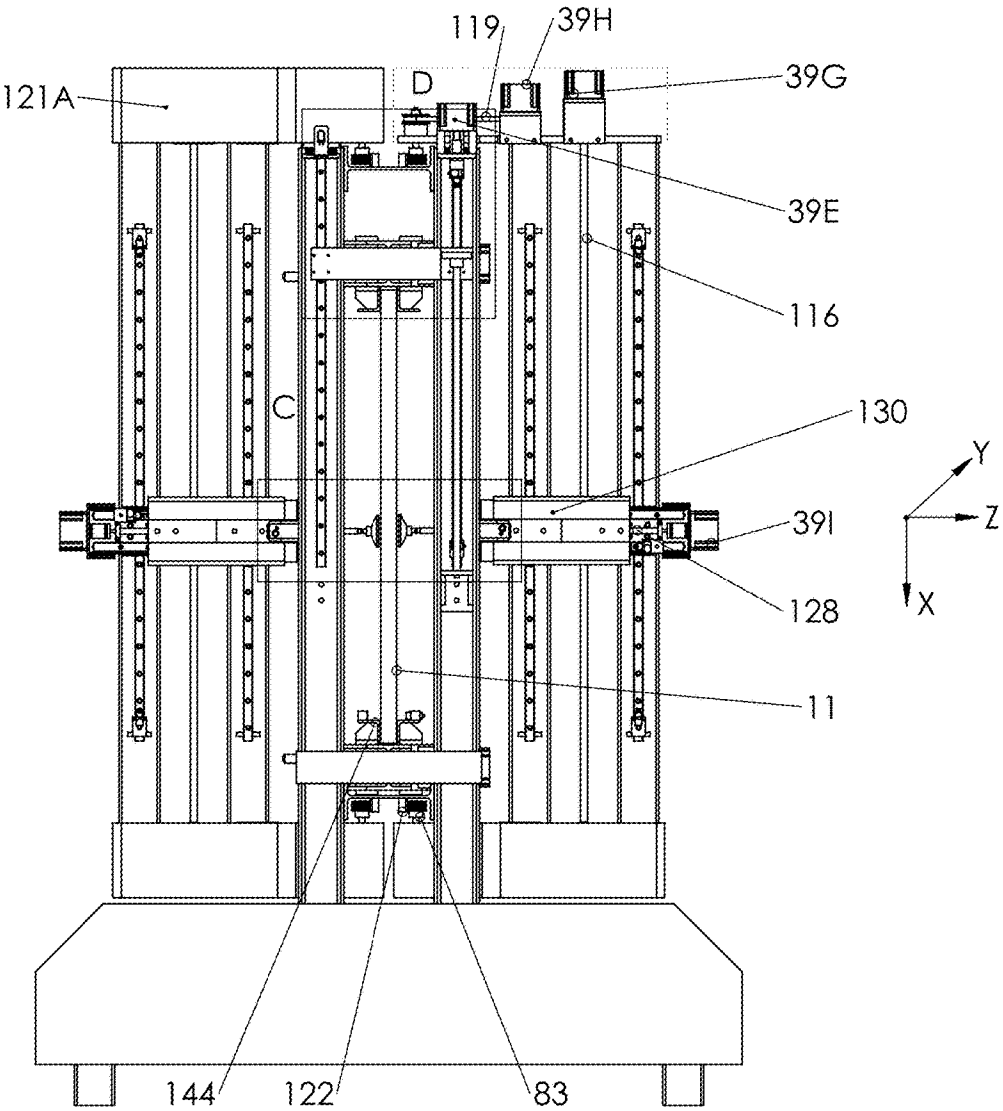
FIG. 7A is a side view of the multiple gantries computer numerical control workpieces processing station in the "A" direction.

FIG. 7A and detailed views depicted in FIG. 7B and FIG. 7C illustrate some of the key components of the multiple gantries computer numerical control workpieces processing station 102. The rotation of stepper motor 39H which engaged timing belt 119 and pinion 83 to move about rack 122 allows the motion of gantry 121A in the Y direction. There is a similar arrangement for the motion of gantry 121B. On each gantry motor 39G and lead screw 116 allow for the motion of router 130 in the X direction whereas motor 39I and lead screw 128 are used for the router motion in the Z direction.

Figure 8:
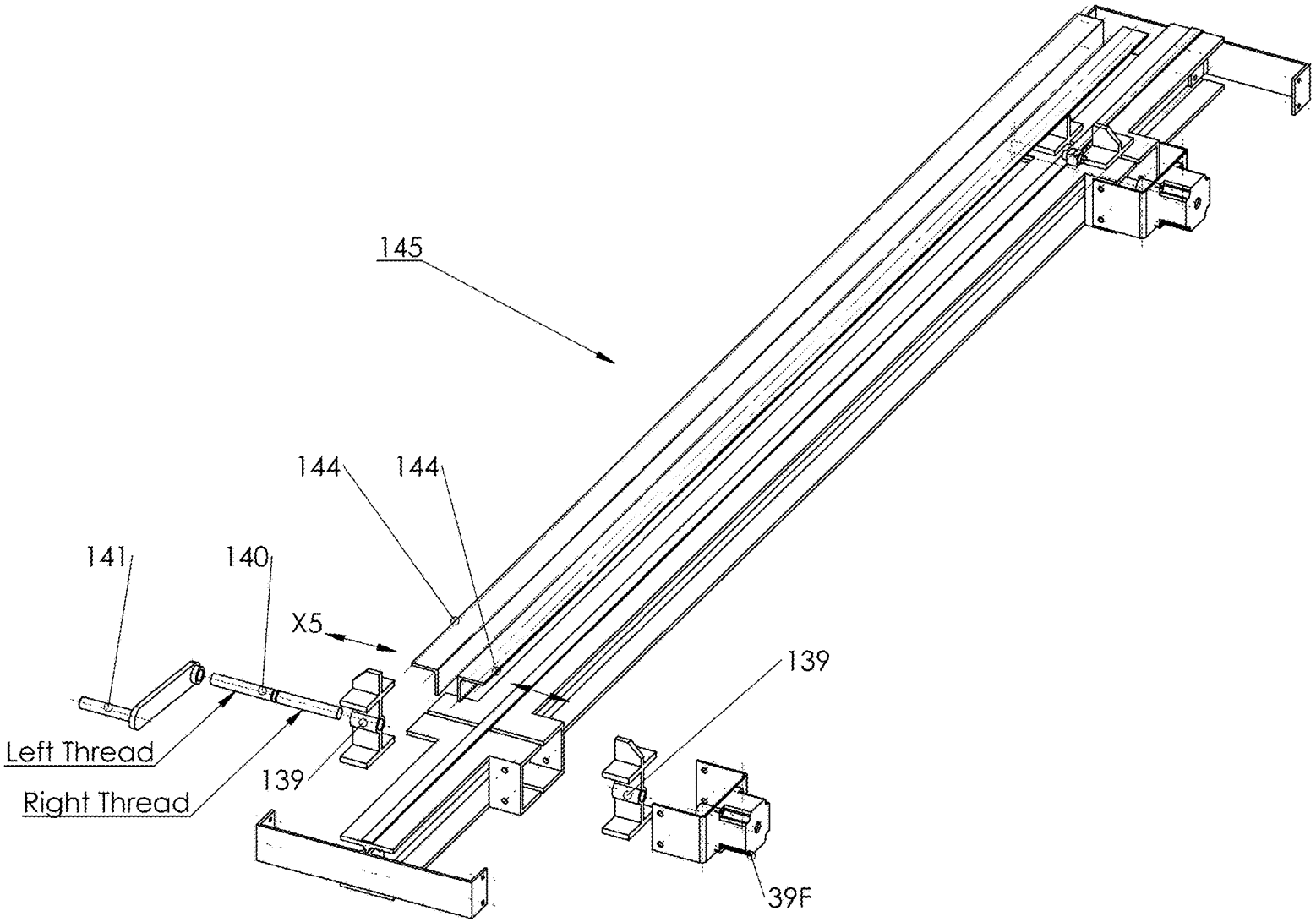
FIG. 8 is an exploded view of the stationary workpiece clamping system within the multiple gantries computer numerical control workpieces processing station.

FIG. 8 is an exploded view of the stationary workpiece clamping system 145 with its main components shown. It should be noted that the height-adjustable workpiece clamping system 146 has similar components. Stepper motor 39F is used to rotate threaded rod 140 which has both left and right threads on each half. This arrangement allow threaded rod 140 while engaged in threaded parts 139, to move them in opposing motion along the X5 axis, such that while physically linked to clamping bars 144, a clamping force is created on workpiece 11. Handle 141 is further used to manually increase or decrease the clamping force.

Figure 9B:
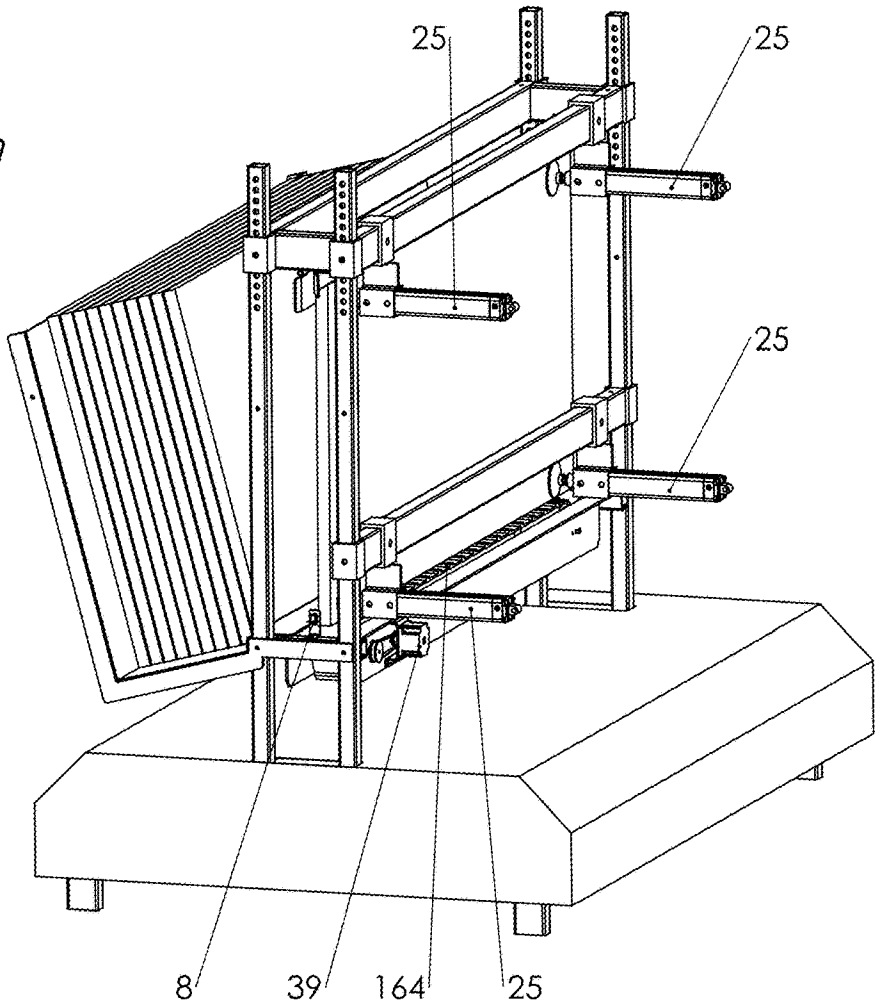
FIG. 9B is an isometric view of the storage station.
Figure 9A:
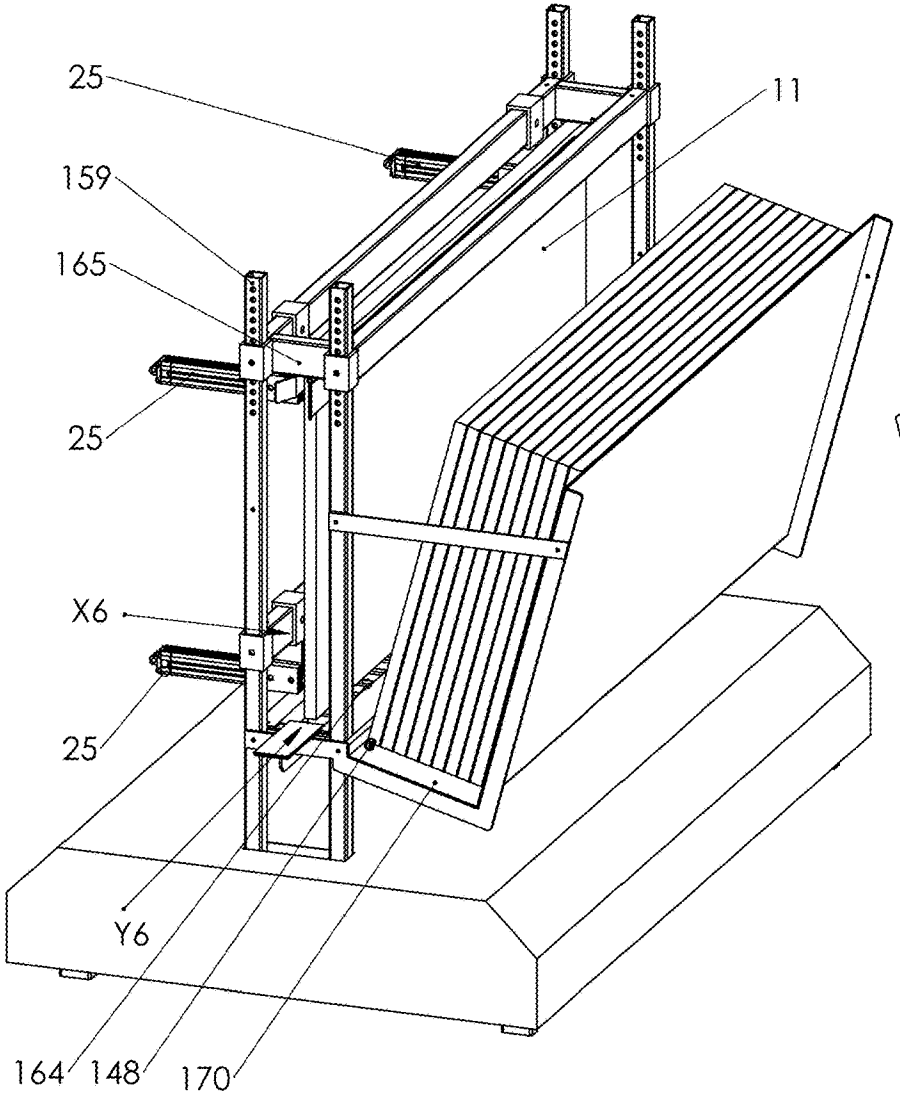
FIG. 9A is an isometric view of the storage station.

FIG. 9A and FIG. 9B illustrate some key components of storage station 103 in the front-right side and back-left side views respectively. While receiving workpiece 11 from station 102, a bottom conveyor 164 is activated to further moves workpiece 11 in the Y6 direction for storage. When workpiece 11 reaches its end of travel, a limit switch 8 detects it and stops conveyor 164 driven by motor 39. Four sets of pushing actuator 25 are used to push workpiece 11 in the X6 direction toward receiving rack 170. When the rack is full, optical switch 148 detects it and sends a signal to the main machine controller which activated a buzz for operator assistance. A guide 165 allows the two top actuators 25 to move up and down about the four poles 159 in order to adjust for different workpiece height. To adjust and secure the working height of the two top actuators 25, multiple set of holes on poles 159 are used.

Figure 10B:
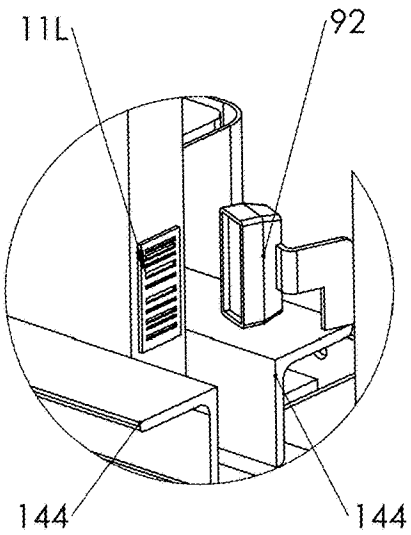
FIG. 10B illustrates how the information is read from the labels affixed to the workpiece and processed with an optical, magnetic or RFD reader.
Figure 10A:
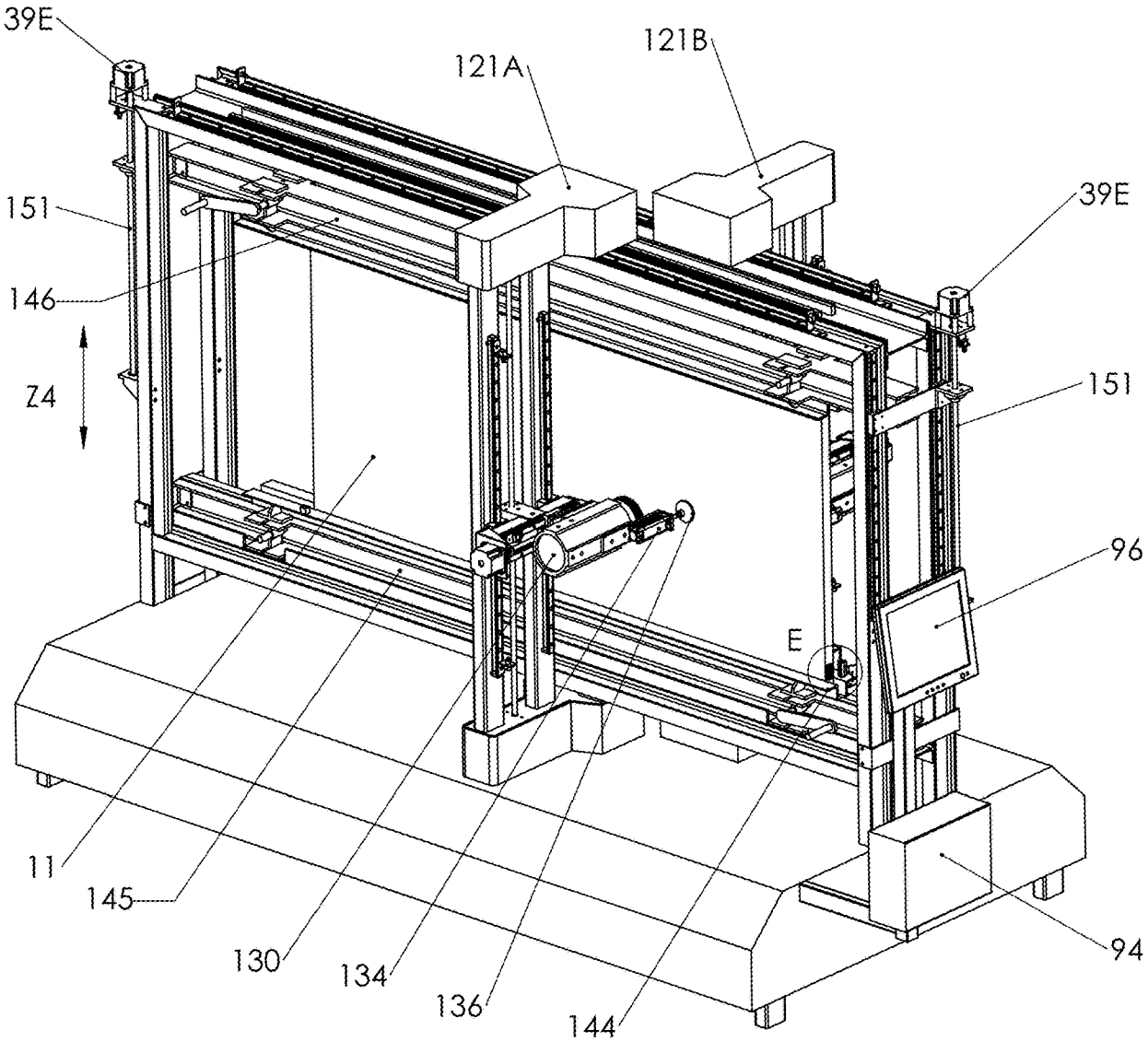
FIG. 10A illustrates the dual gantry computer numerical control workpieces processing station.

FIG. 10A illustrates the multiple gantries computer numerical control workpieces processing station 102 as a stand-alone apparatus which can be controlled with computer 94 and the user interface system 96. There are two independent gantries 121A and 121B which allow the processing of two independent patterns or operations simultaneously on both sides on workpiece 11. Even though one of the preferred embodiments is shown with two routers 130 (only one shown), each gantry can be mounted with different apparatus such as, laser engraver, sand or particles blasting, product dispensing, and more such that a given workpiece can be processed with different operations or patterns on both sides. Furthermore the router 130 can be equipped with a right angle router head to allow machining of workpiece other sides. While workpiece 11 is processed in station 102, one top height-adjustable clamp 146 and one bottom stationary clamp 145, are used to hold workpiece 11 in place with the actuation of stepper motor 39F and clamping bars 144. To allow clamping of different workpiece height, top height-adjustable clamp 146 is allowed to move in the Z4 direction by the motion of two stepper motors 39E and lead screws 151.

When work is completed on workpiece 11, two sets of clamping device 136 and their respective actuator 134 hold firmly workpiece 11 which is removed from the multiple gantries computer numerical control workpieces processing station 102 by the simultaneous rearward motion of gantries 121A and 121B.

FIG. 10B illustrates how the information is read from the labels 11L affixed to workpiece 11 and processed with an optical, magnetic or RFID reader 92 system that reads the information on the labels 11L and sends it to the computer 94 for further processing. The labels have information such as, the workpiece size, the workpiece material, the patterns to be engraved or routed, the router speed based on material and operations, and any other operations to be performed on the multiple gantries computer numerical control workpieces processing station 102.

Figure 11B:
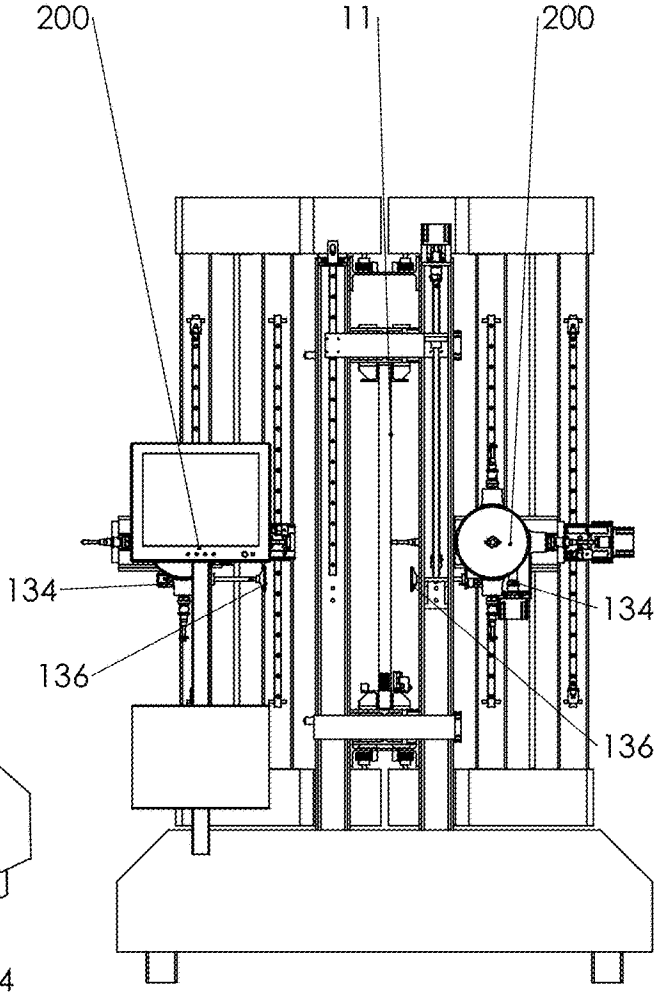
FIG. 11B is a side view of the dual gantry computer numerical control workpieces processing station showing the two optional rotating tool changers.
Figure 11A:
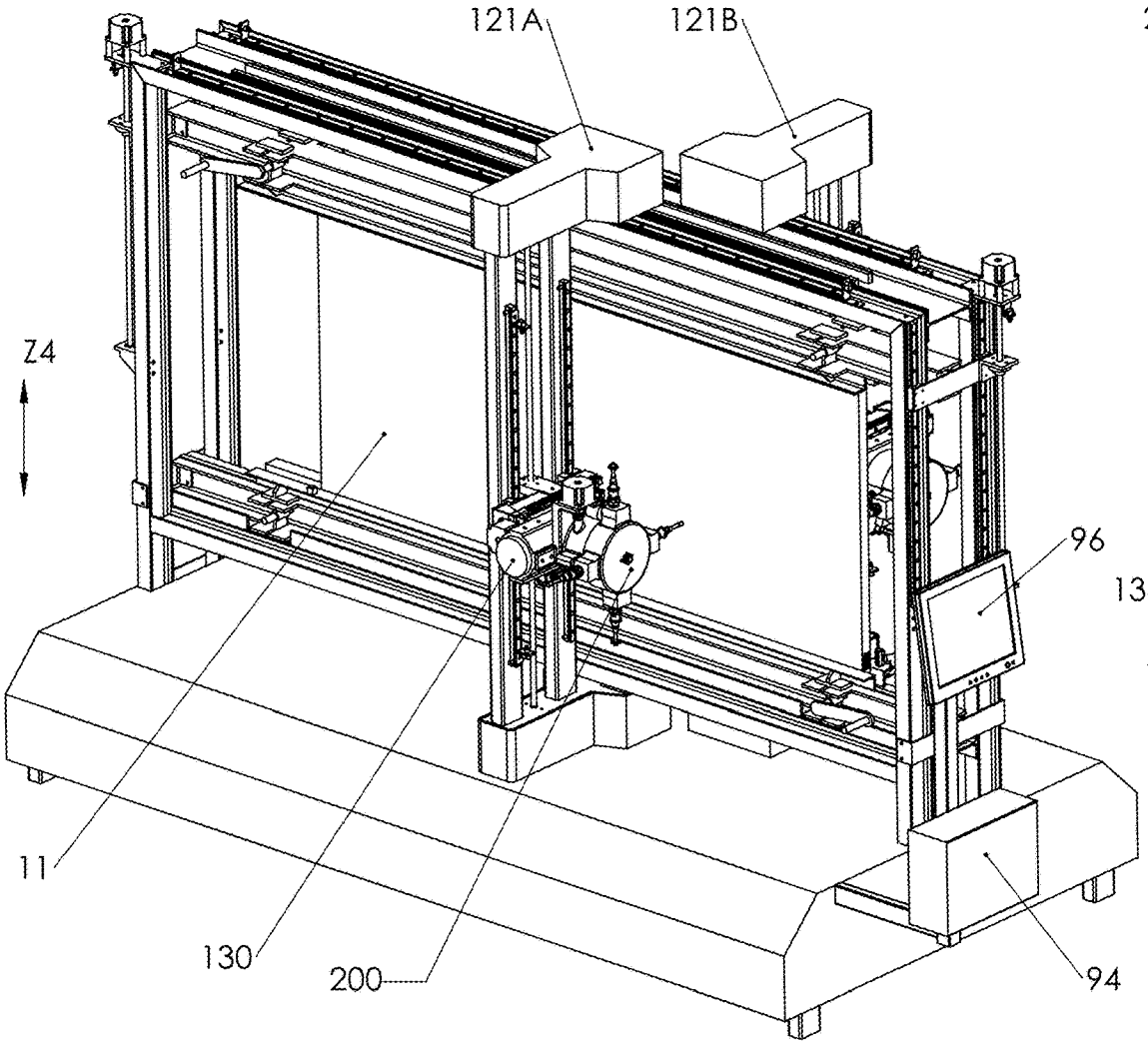
FIG. 11A is an isometric view of the dual gantry computer numerical control workpieces processing station with the optional rotating tool changer.

FIG. 11A further illustrates the multiple gantries computer numerical control workpieces processing station 102 as a stand-alone apparatus with a rotating tool changer 200 which is mounted on gantries 121A and 121B. The rotating tool changer 200 mechanically connected to router 130 is fitted with different tools that can be used to machine complex pattern on workpiece 11. The tool selection is controlled within the work processing program with computer 94 and/or the user interface system 96.

FIG. 11B further illustrates the multiple gantries computer numerical control workpieces processing station 102 as a stand-alone apparatus fitted with two rotating tool changers 200. When work is completed on workpiece 11, two sets of clamping device 136 and their respective actuator 134 hold firmly workpiece 11 which is removed from the multiple gantries computer numerical control workpieces processing station 102 by the simultaneous rearward motion of gantries 121A and 121B.

Figure 12B:
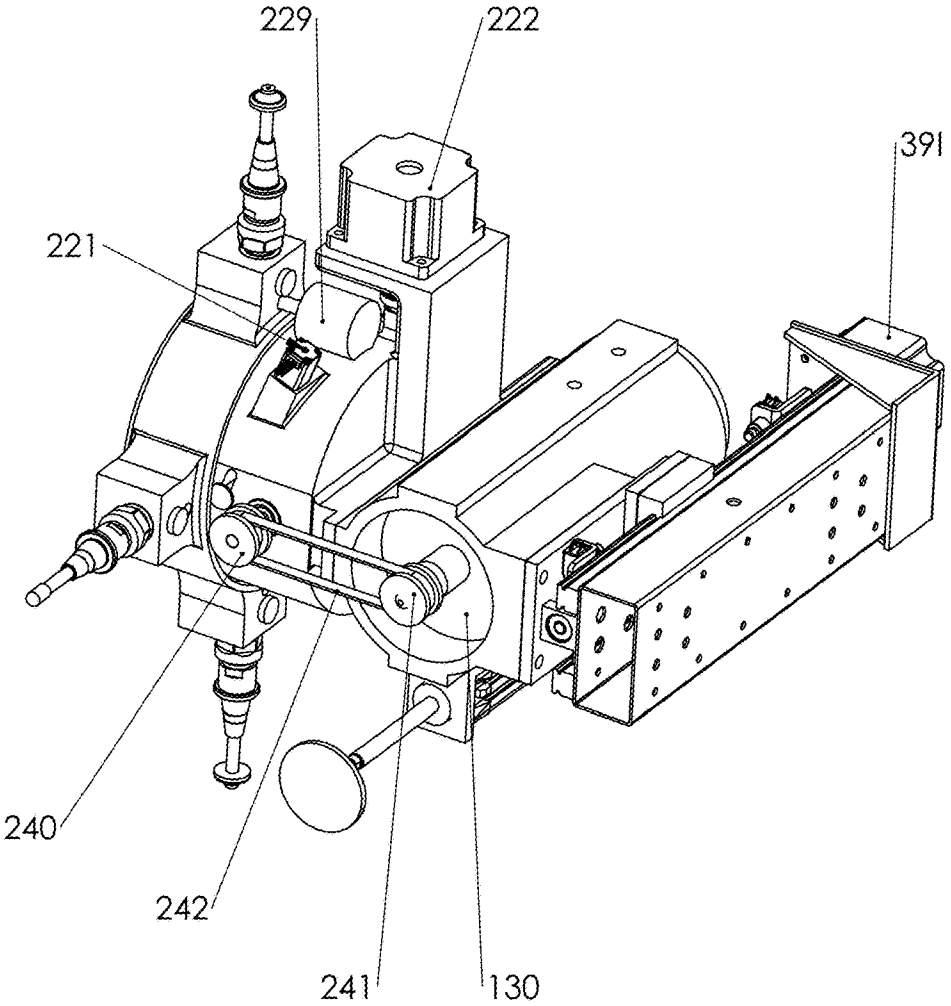
FIG. 12B is an isometric view of the rotating tool changer showing its mounting to the z-drive axis and drive connection to the router's motor.
Figure 12A:
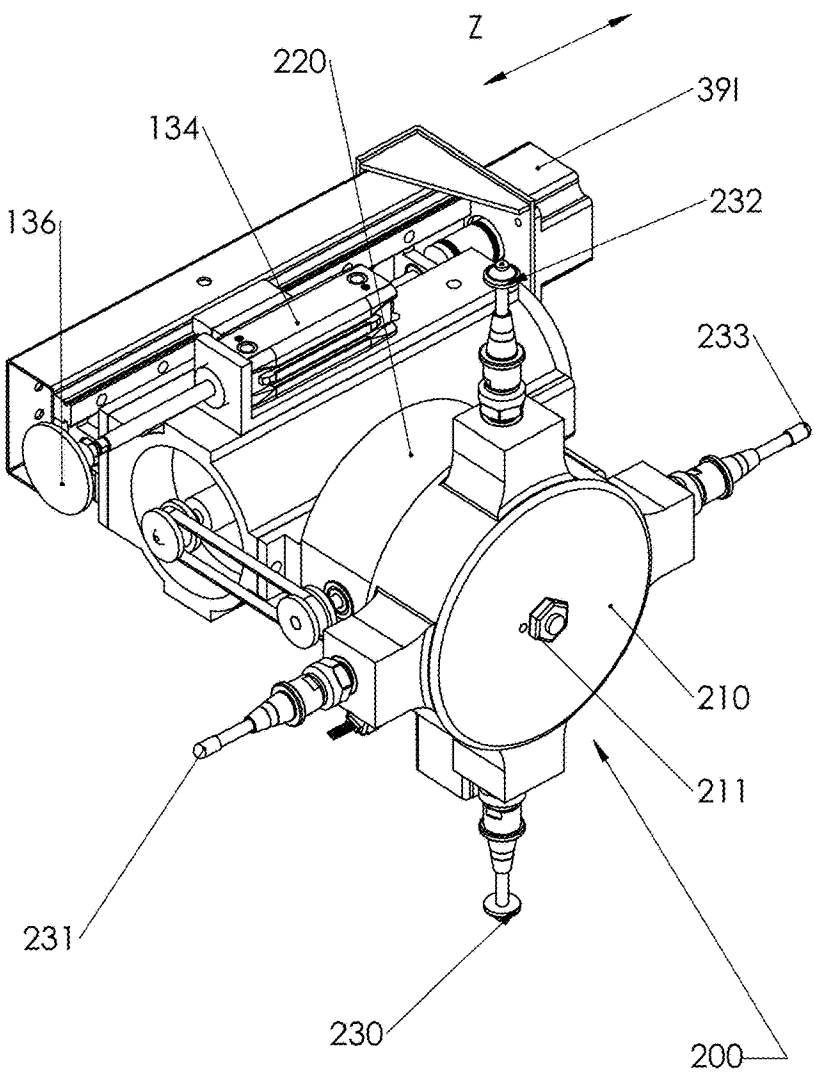
FIG. 12A is an isometric view of the rotating tool changer showing its mounting to the z-drive axis.

FIG. 12A illustrates the rotating tool changer 200 fitted with four tools 230, 231, 232 and 233. Rotating tool changer is comprised of a fixed base 220 and a rotating part 210 which is secured with locking nut 211. Rotating tool changer 200 is tied up to the z-axis controlled from the relative motion of motor 39I. Clamping device 136 and actuator 134 are used to displace workpiece 11.

FIG. 12B further illustrates the rotating tool changer 200 and its mechanical connection to router 130 which is fitted with timing pulley 241 driving timing pulley 240 from the mechanical connection of timing belt 242. The relative motion of timing pulley 240 allows for the sequential rotation of any of the four tools 230, 231, 232 and 233. Motor 222 and actuator 221 are respectively used to position and lock in place any of the four tools. Linear lock actuator 229 which activated an actuator that goes into a hole in rotating part 210 is an added security to lock in place rotating part 210 to the fixed base 220 while any of the four tools 230, 231, 232 and 233 is rotating in order to machine workpiece 11.

Figure 13B:
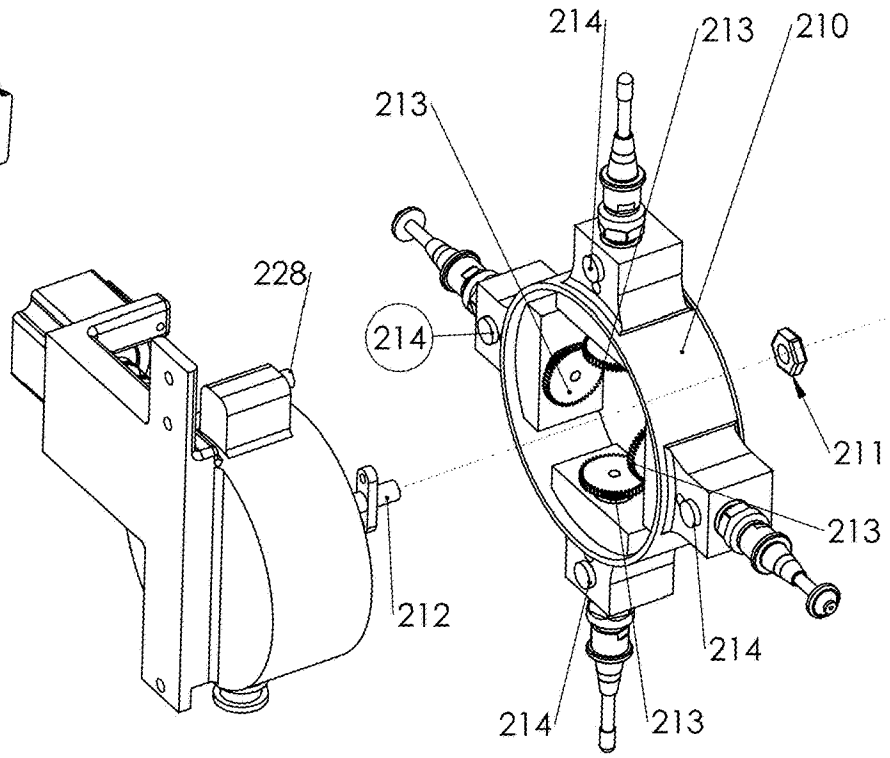
FIG. 13B is an exploded view of the rotating tool changer showing its fixed base and rotating tool mounting part.
Figure 13A:
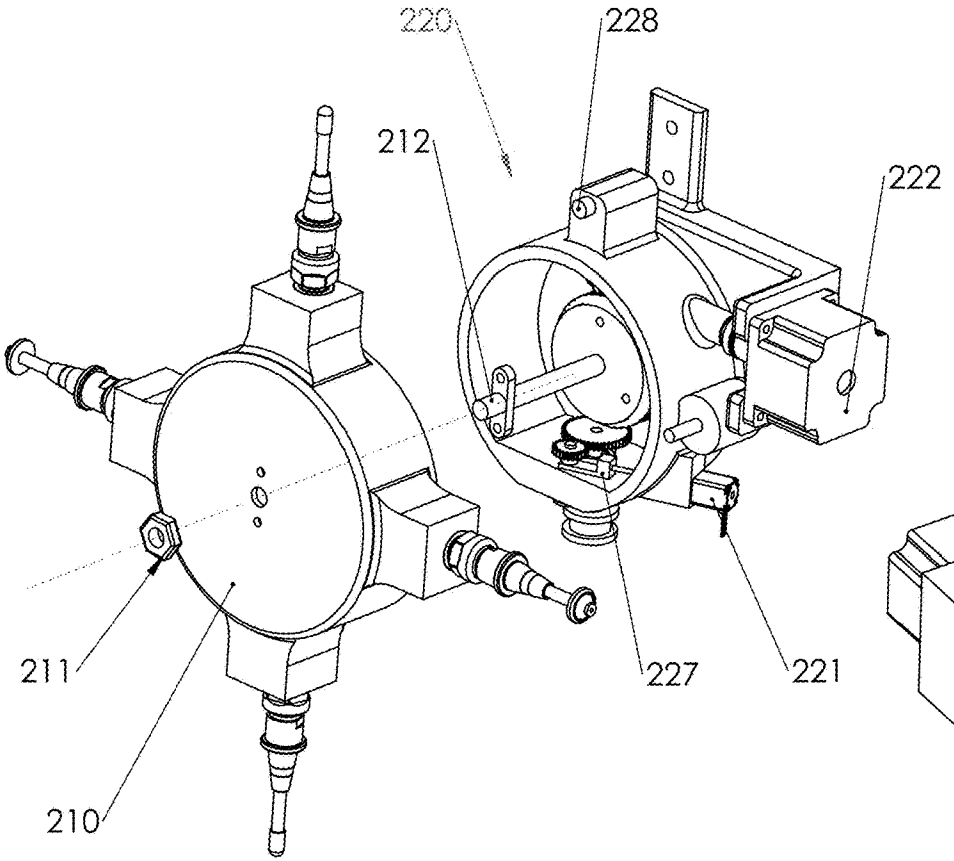
FIG. 13A is an exploded view of the rotating tool changer showing its fixed base and rotating tool mounting part.

FIG. 13A and FIG. 13B illustrate some main components of the rotating tool changer and the mounting of the rotating part 210 to the fixed base 220. Rotating part 210 which rotates to position any tools from the actuation of motor 222 is axially mounted to fixed base 220. Rotating part 210 is tied up by locking nut 211 to threaded part 212. Actuator 221 allows the engage/disengage mechanism 227 to drive any of the four gear 213 which is directly connected to the machining tool. Tool position sensor 228 allows the precise positioning and detection of any of the four tools 230, 231, 232 or 233 by reading information contained in tool tag 214.

Figure 14B:
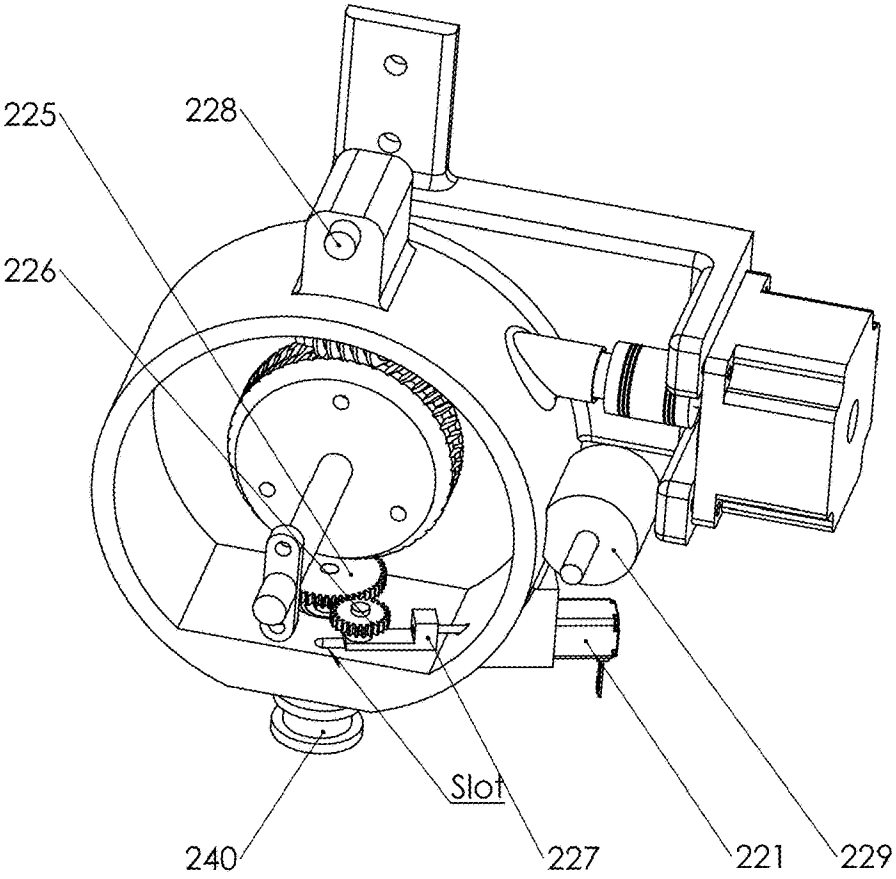
FIG. 14B is an isometric view of the rotating tool changer showing its fixed base and the inside main components.
Figure 14A:
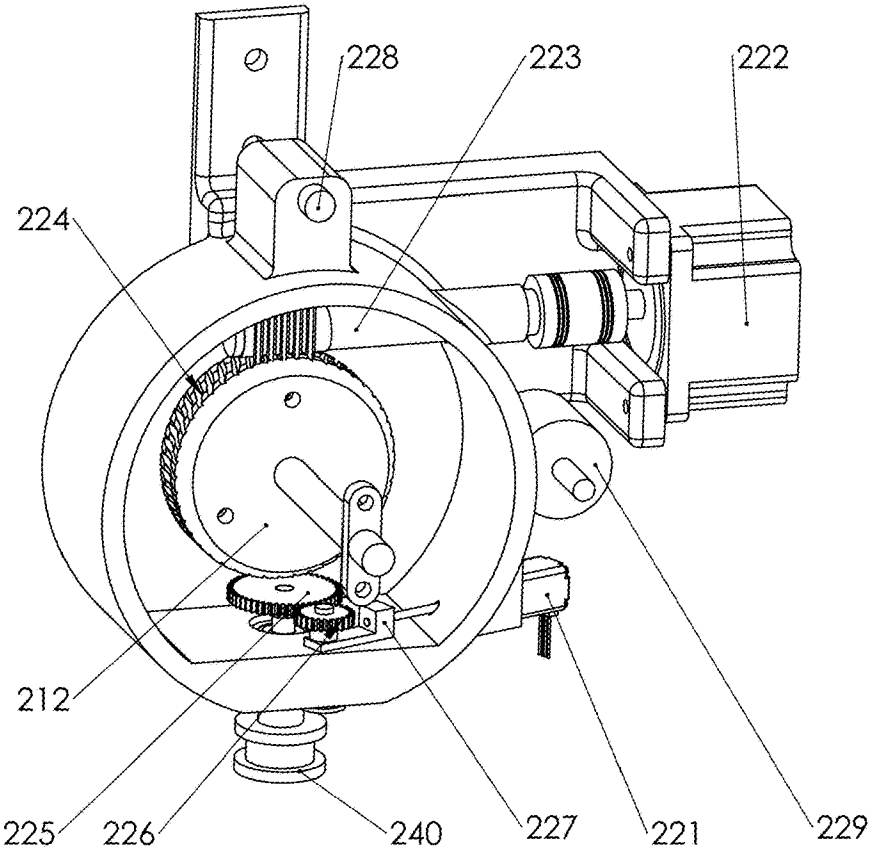
FIG. 14A is an isometric view of the rotating tool changer showing its fixed base and the inside main components.

FIG. 14A and FIG. 14B illustrate the inner working of fixed base 220 and its main components. Motor 222 drives a self-locking worm drive composed of a worm shaft 223 and a worm gear 224. The self-locking property of the worm drive allows the precise positioning of rotating part 210 and locking in place of any of the four tools 230, 231, 232 and 233. Motor 222 allows the rotation of rotating part 210 from the rotation of worm shaft 223 and worm gear 224 which is tied to connecting part 212 with its threaded end fasten to rotating part 210. The engage/disengage mechanism 227 driven by actuator 221 moves gear 226 in order to mechanically link gear 225 which is powered from router 130 connected to timing pulley 240 to any of the four gear 213. The motion of motor 222 which positions any of the four tools 230, 231, 232 and 233 by reading opposite tool tag 214 is also controlled by the tool position sensor 228 which sends a signal to the motor 222 controller for precise positioning. While motor 222 is operating, linear lock actuator 229 is retracted and is activated only after rotating part 210 is positioned to allow any of the four tools 230, 231, 232 or 233 to machine the workpiece. Activation of linear lock actuator 229 allows its moving part to go into a hole in rotating part 210 to lock it in place to the fixed base 220 in order to prevent unexpected rotation.

Figure 15B:
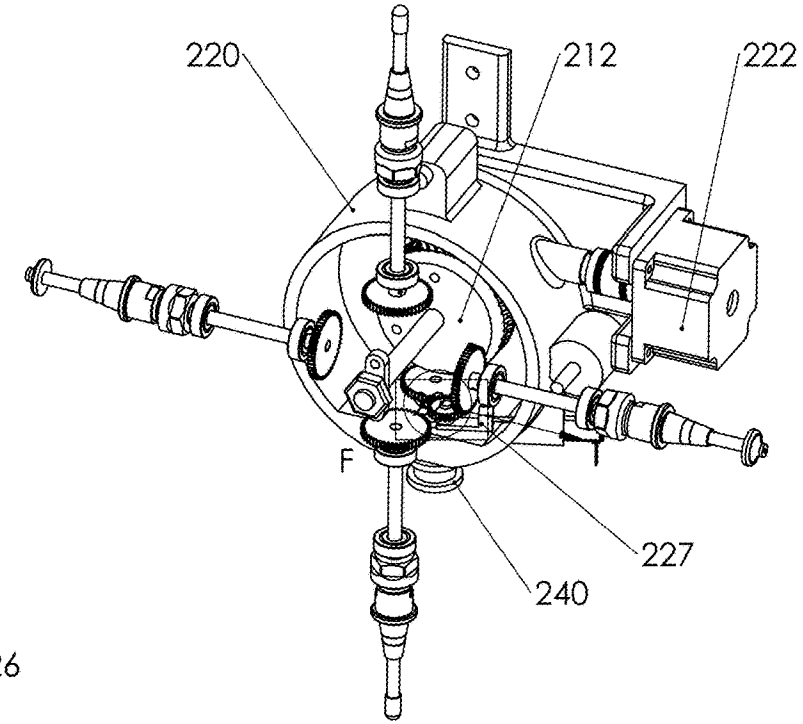
FIG. 15B is an isometric view of the rotating tool changer showing its fixed base and the rotating part main components in a displaced configuration without its cover.
Figure 15C:
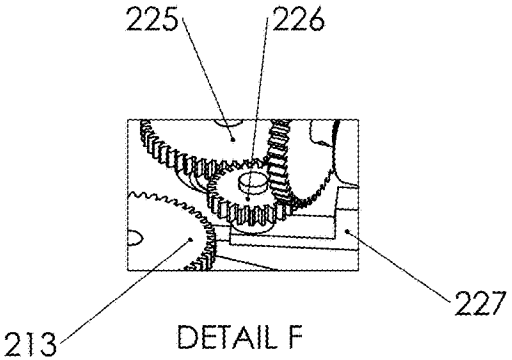
FIG. 15C is detailed view of one of the drive mechanism within the rotating tool changer.
Figure 15A:
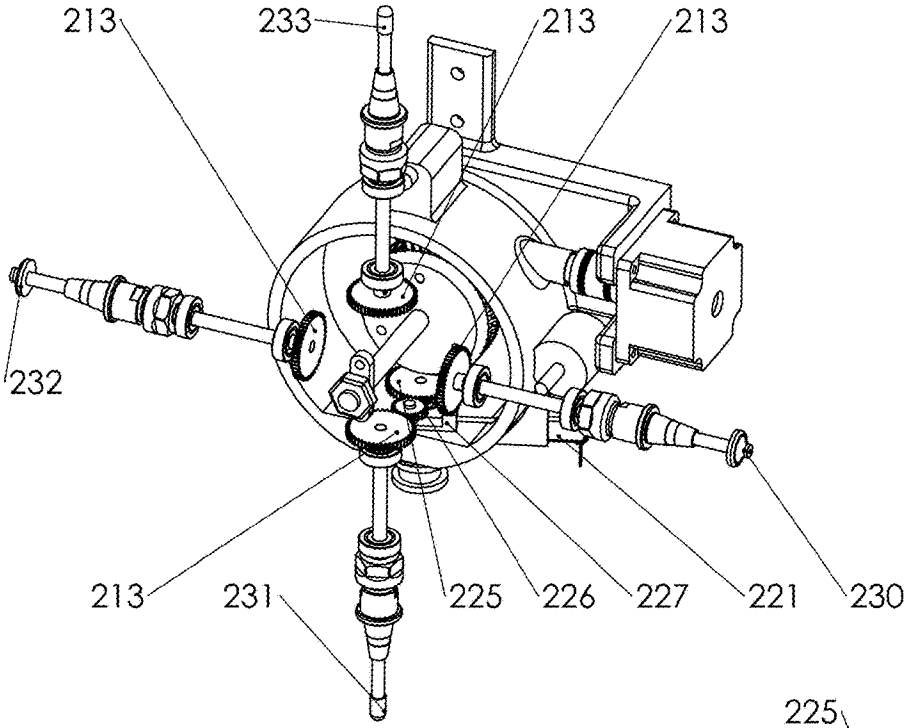
FIG. 15A is an isometric view of the rotating tool changer showing its fixed base and the rotating part main components without its cover.

FIG. 15A, FIG. 15B, and FIG. 15C illustrate the inner working of tool changer 200. In this illustration, tool 231 is positioned for turning. While in position, the engage/disengage mechanism 227 driven by actuator 221 moves in place and allows via its gear 226, tool gear 213 to rotate from the powered motion of gear 225. To position another tool such as tool 230, 232 or 233, the engage/disengage mechanism 227 moves to the right as shown in FIG. 15B, and FIG. 15C. This allows tool gear 213 to be mechanically disconnected from router powered gear 225. Motor 222 can then positioned via connecting part 212 any other tool such as tool 230, 232 or 233. It should be noted that while tool changing operation occurred, router powered gear 225 is stopped and resume rotation after precise positioning and control command from the workpiece programing code.

Figure 16:
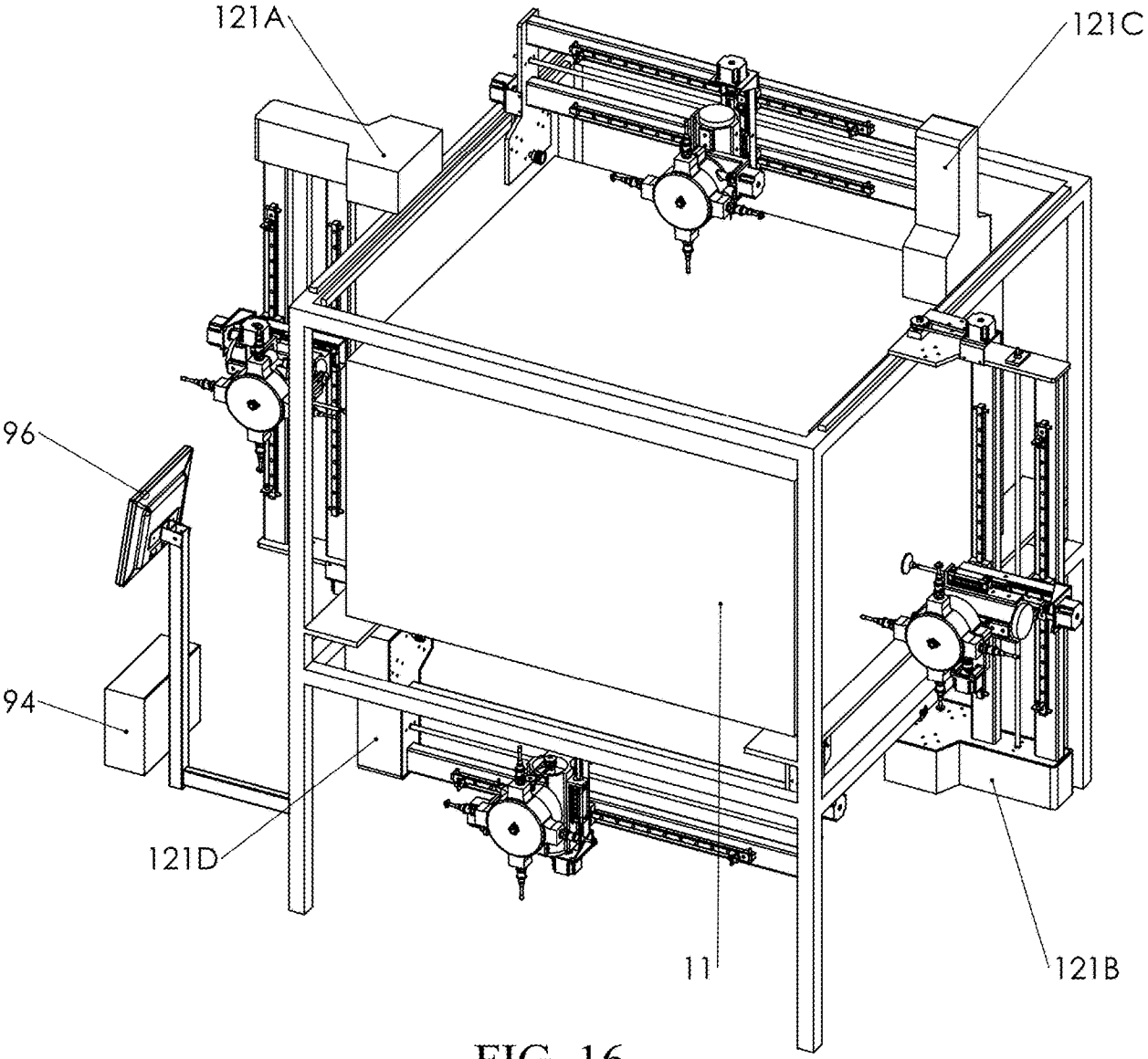
FIG. 16 illustrates a schematic of the multiple gantries computer numerical control workpieces processing station with four gantries.

FIG. 16 illustrates a mechanical system of the multiple gantries computer numerical control workpieces processing station 102 as a stand-alone apparatus which can be controlled with computer 94 and the user interface system 96. There are four independent gantries 121A, 121B, 121C and 121D which allow the processing of four independent patterns or operations simultaneously or sequentially on four sides on workpiece 11.

Figure 17:
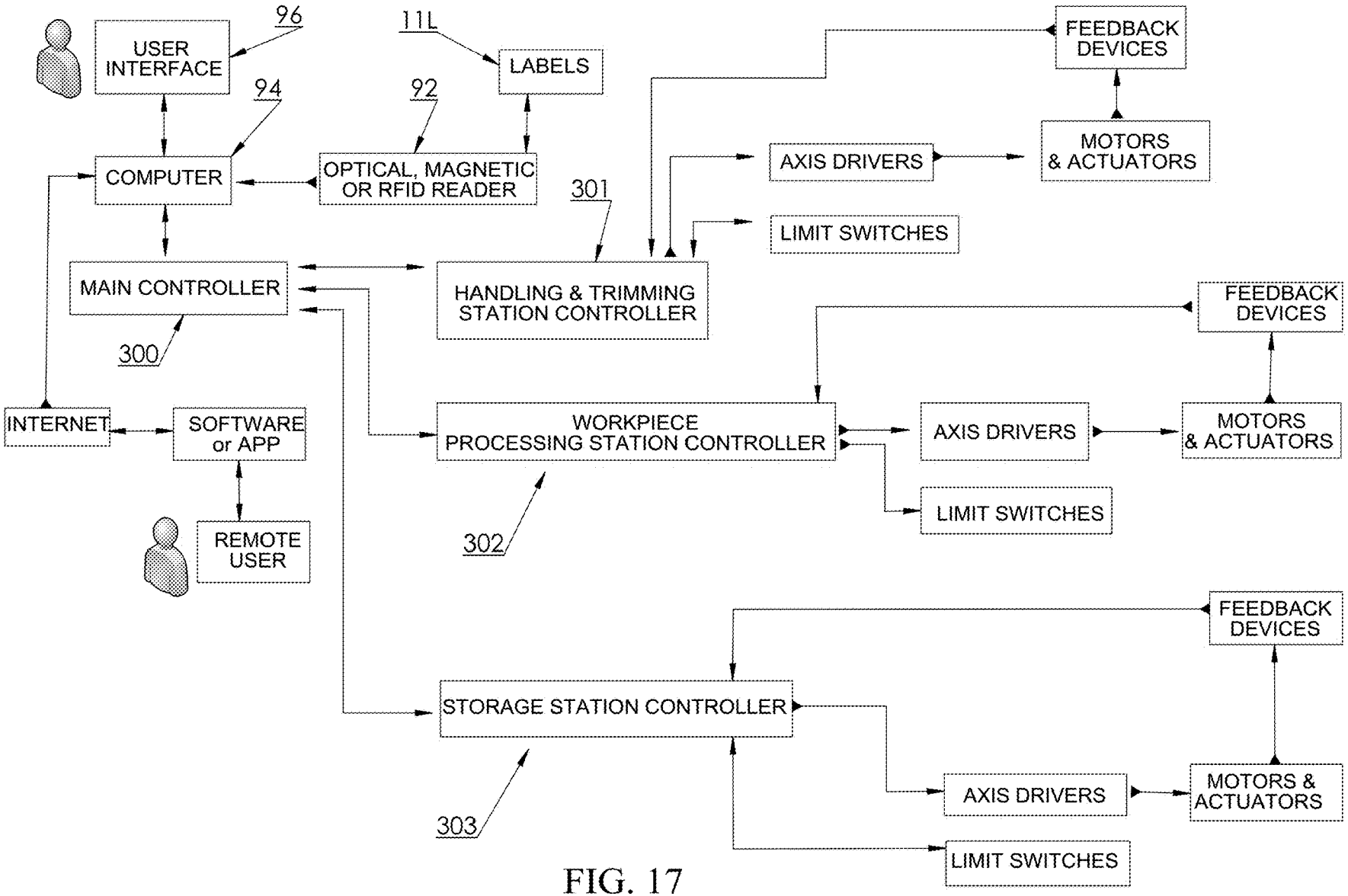
FIG. 17 is schematic depicting a control diagram according to one embodiment of the present invention.

FIG. 17 illustrates a schematic control diagram according to one embodiment of the present invention. A main machine controller 300 is used to receive information from a computer 94 which holds a parametric programming code, various subroutines and database of parametric numerical control files for pattern machining or processing of workpiece 11. Optical, magnetic or RFID reader 92 receives information from labels 11L which is then processed in computer 94. Workpiece 11 trimming height if necessary, parametric numerical control files for each side of workpiece 11 are derived from workpiece size and patterns to apply from reading labels 11L. User interface 96 or a remote user connected through the internet can also be used to program the sequences of operation or order work specific custom made workpieces. The main machine controller 300 then drives the controllers 301, 302 and 303 of respectively stations 101, 102 and 103. Each station controller drives its respective axis drivers, motors and actuators with feedback devices for precise positioning and limit switches and sensing devices for travel limiting and work processing control.

The present disclosure is not confined in scope described by the embodiments presented herein. Other embodiments and modifications of the present disclosure can be obtained which will still fall within the scope of the present disclosure.

Although the present disclosure and embodiments have been described for panels machining, it should be apparent for those of ordinary skill in the art that the method and apparatus described can be adapted to other forms of workpiece for various type of processing using the method described herein.

Thus, the scope of the invention should be determined by the claims set forth below and their legal equivalents.

What is claimed is:

1. An apparatus for automated multiple sides workpiece machining comprising of:

(A) a user interface system which is used to program the apparatus operation, interact with the apparatus, and display apparatus outputs;

(B) a computer connected to the user interface system, wherein the computer has means for storing parametric numerical control files, and computer programs for reading and processing the parametric numerical control files;

(C) at least one machine readable tag affixed to the workpiece;

(D) at least one information retrieving device which is used to retrieve workpiece processing information contained in the at least one machine readable tag, wherein said workpiece processing information is sent to the computer for selecting the corresponding parametric control file and required processing;

(E) an automated workpieces handling and trimming station, wherein the automated workpieces handling and trimming station includes:

a loading compartment with two synchronized indexing mechanisms, one indexing mechanism at a fixed height and the other indexing mechanism at an adjustable height to fit various workpieces sizes, wherein the two synchronized indexing mechanisms feed workpieces for further processing, a set of bottom clamping devices mounted to rotating retractable arms, wherein the set of bottom clamping devices are used to securely hold in place the workpiece during processing, a set of top clamping devices mounted to a two-axis linear motion arm with one rotating degree of freedom, wherein the set of top clamping devices are used to hold and displace the workpiece and any severed piece of workpiece, and a trimming device with interchangeable trimming tools mounted to a movable gantry, wherein the trimming device trims the workpiece if required from the information contained in the machine readable tag or preprogrammed sequences entered locally or remotely on the user interface system;

(F) a multiple gantries computer numerical control workpieces processing station that simultaneously or sequentially processes workpiece on its various sides with preprogrammed operations; and (G) a storage station that receives workpieces in sequential order when they have been processed.

2. The apparatus of claim 1, wherein said computer comprises at least one computer code library of patterns and operations to be machined on the workpieces and said patterns and operations are automatically resized with parametric programming codes to fit workpieces sizes.

3. The apparatus of claim 1, wherein said automated workpieces and trimming station can at least be configured to handle workpieces of various shapes such as: flat, cubical, spherical, pyramidal or others forms.

4. The apparatus of claim 1, wherein said trimming device is at least one of a: cutting, routing, laser cutting, waterjet cutting, drilling, wire cutting, torch or plasma cutting tool.

5. The apparatus of claim 1, wherein said multiple gantries computer numerical control workpieces processing station is a dual gantry computer numerical control station with independent gantries that can process workpieces simultaneously on both sides with various operations.

6. The apparatus of claim 1, wherein said multiple gantries computer numerical control workpieces processing station is a four gantries computer numerical control station with independent gantries located left, right, top and bottom that can process cubical workpieces simultaneously on four sides with various operations.

7. An apparatus for automated multiple sides workpiece machining comprising:

(A) a frame;

(B) a user interface system connected to the frame which is used to program the apparatus operation, interact with the apparatus, and display apparatus outputs;

(C) a computer connected to the user interface system, wherein the computer has means for storing parametric numerical control files and computer programs for reading and processing the parametric numerical control files;

(D) at least one machine readable tag affixed to the workpiece;

(E) at least one information retrieving device which is used to retrieve workpiece processing information contained in the at least one machine readable tag, wherein said workpiece processing information is sent to the computer for selecting the corresponding parametric control file and required processing;

(F) a stationary workpiece clamping device mounted on the frame;

(G) a height-adjustable workpiece clamping device mounted on the frame;

(H) at least one gantry linearly moveable along the frame, wherein the at least one gantry is used to simultaneously or sequentially processed workpiece on its various sides with preprogrammed operations;

(I) at least one rotating tool changer mounted to the at least one gantry;

(J) at least one moving workpiece clamping device mounted to the at least one gantry, wherein the at least one moving workpiece clamping device is used to remove workpiece from the apparatus.

8. The apparatus of claim 7, wherein said at least one gantry is a dual gantry with each gantry vertically and opposite mounted on the said frame.

9. The apparatus of claim 7, wherein said at least one gantry is a dual gantry with each gantry horizontally and opposite mounted on the said frame.

10. The apparatus of claim 7, wherein said at least one gantry is a dual gantry with each gantry mounted at a variable angle relative to each other on the said frame.

11. The apparatus of claim 7, wherein said at least one gantry is a four-gantry with two gantries horizontally and opposite mounted and two gantries vertically and opposite mounted on the said frame.

12. A method for automated multiple sides workpiece machining comprising of:

(A) codifying at least one machine readable tag or label with workpiece size, material and machining operations;

(B) affixing at least one machine readable tag or label to the workpiece;

(C) reading the information on the at least one machine readable tag or label and sending the said information to a computer for processing;

(D) generating parametric machining codes based on a library of machining patterns and operations stored in a computer;

(E) compiling parametric machining codes to fit workpiece size and machining operations;

(F) driving a trimming station apparatus for sizing the workpiece according to the information contained on the at least one machine readable tag or label;

(G) driving a multiple gantries computer numerical control processing station apparatus for machining the workpiece according to the information contained on the at least one machine readable tag or label and the parametric machining codes;

(H) storing the workpiece on a storage station after all operations on workpiece have been performed.

13. The method of claim 12, wherein said information on the at least one machine readable tag or label can be sent directly to the computer by other electronics means such as wired or wireless communication.

14. The method of claim 12, wherein said parametric machining codes can be remotely created on a display using a library of patterns, signs and characters.

15. The method of claim 12, further comprising a software as a service program, wherein said software as a service is a computer program or an application connected to the internet which is used to remotely machine workpieces on their various sides.

16. The apparatus of claim 1, wherein said apparatus is used to simultaneously machine panels or doors on both sides using a dual gantry computer numerical control workpieces processing station.

17. The method of claim 12, wherein said method is used to simultaneously machine panels or doors on both sides using a dual gantry computer numerical control workpieces processing station.

* * * * *